US007912390B2

(12) United States Patent
Mitsui

(10) Patent No.: US 7,912,390 B2
(45) Date of Patent: Mar. 22, 2011

(54) IMAGE FORMING APPARATUS

(75) Inventor: Yoshihiro Mitsui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 12/425,037

(22) Filed: Apr. 16, 2009

(65) Prior Publication Data

US 2009/0269094 A1 Oct. 29, 2009

(30) Foreign Application Priority Data

Apr. 23, 2008 (JP) ..... 2008-113252

(51) Int. Cl.
*G03G 15/10* (2006.01)

(52) U.S. Cl. ..... 399/61; 399/27; 399/252; 399/285

(58) Field of Classification Search ..... 399/27, 399/30, 55, 61, 252, 259, 281, 285, 295
See application file for complete search history.

(56) References Cited

U.S. PATENT DOCUMENTS

| | | | | |
|---|---|---|---|---|
| 6,501,933 | B2 | 12/2002 | Ishii | |
| 2001/0050706 | A1 | 12/2001 | Ishii | |
| 2007/0110481 | A1* | 5/2007 | Yamada et al. | 399/279 |

FOREIGN PATENT DOCUMENTS

| | | | |
|---|---|---|---|
| JP | 4-234777 | A | 8/1992 |
| JP | 6-19296 | A | 1/1994 |
| JP | 8-114977 | A | 5/1996 |
| JP | 2001-350339 | A | 12/2001 |

OTHER PUBLICATIONS

Translation of JP 4234777.*

* cited by examiner

*Primary Examiner* — David M Gray
*Assistant Examiner* — Barnabas T Fekete
(74) *Attorney, Agent, or Firm* — Fitzpatrick, Cella, Harper & Scinto

(57) ABSTRACT

An image forming apparatus include an image bearing member, a developing container receiving a developer, a developer carrying member for carrying and conveying the developer, a developer feed member for supplying the developer to the developer carrying member, a detection device for detecting an amount of developer in the developing container by detecting an electrostatic capacitance between the developer carrying member and the developer feed member, and a control device for changing a rotational speed of the developer feed member into a plurality of speeds corresponding to the plurality of image forming speeds. The control unit controls the rotational speed of the developer feed member prior to the execution of a detection operation of the detection device so as to be faster than the slowest speed of said plurality of speeds.

5 Claims, 15 Drawing Sheets

PRIOR ART

PRIOR ART

IMAGE FORMING APPARATUS

BACKGROUND OF THE INVENTION

1. Field of the Invention

The present invention relates to an image forming apparatus that forms an electrostatic image on an image by means of, for example, an electrophotographic method or an electrostatic recording method.

2. Description of the Related Art

As a device for detecting a remaining amount of developer in an image forming apparatus, there has been one that is shown in FIG. 15, for example. More specifically explaining this device, a magnetic single component developer in a developing container 70 is sent to a developing chamber 73 by means of a developer feeding member 72. The developing chamber 73 has a sleeve 75 which internally contains a fixed magnet 74 therein and which rotates in a direction of an illustrated arrow, the sleeve 75 being arranged in opposition to a photosensitive drum 76. Also, on the sleeve 75, there is arranged an elastic blade 77 for coating the developer sent into the developing chamber 73. The distance between the sleeve 75 and the photosensitive drum 76 is in the range of 50μ-500μ, and a developing bias, which is generated by superposing an alternating current on a direct current by means of a developing bias power supply 101, is impressed on the sleeve 75, thereby performing so-called jumping development.

Next, reference will be made to a method for detecting the remaining amount of developer in the developing container 70 as explained above. A reference numeral 78 denotes an antenna composed of a rod which is made of metal such as stainless steel, etc., and which is arranged in parallel to the sleeve 75. When a developing bias is impressed on the sleeve 75, a voltage is induced in the antenna 78 under the action of an electrostatic capacitance between the sleeve 75 and the antenna 78. Here, note that the voltage induced in the antenna 78 depends on the electrostatic capacitance between the sleeve 75 and the antenna 78. Accordingly, the electrostatic capacitance between the sleeve 75 and the antenna 78 varies between a state where the amount of toner is sufficient to fill a space between the antenna 78 and the sleeve 75 with the developer, and a state where the toner has been consumed with the space between the sleeve 75 and the antenna 78 being not filled with the developer. Therefore, the voltage induced in the antenna 78 varies.

Generally, in a developing unit using a non-magnetic single component developer, a developer holding member is arranged in the development chamber 73. In a case where a developer remaining amount detection method using a change in an electrostatic capacitance is applied to a developing unit using such a non-magnetic single component developer, there will arise problems such as a narrow space for arranging an antenna, a hindrance to the conveyance of the developer, and so on, due to the provision of a coating member.

In order to solve the problems, it is known to use a roller-shaped member that supplies a developer to a sleeve which acts as a developer carrying member, as shown in FIG. 16 (e.g., Japanese Patent Application Laid-Open No. H04-234777). A feed member 80 is constructed to have a urethane sponge arranged on the circumference of a metal support member 79 having electrical conductivity. In addition, when the developer is coated onto a sleeve 95 by means of the feed member 80, a voltage corresponding to an amount of the developer is generated on the electrically conductive support member 79 by impressing an alternating voltage on the sleeve 75. A remaining amount of the developer is detected by the voltage thus induced.

In the method for detecting the voltage induced between the feed member 80 and the sleeve 75 by impressing an alternating voltage therebetween, as shown in the first patent document, a correlation is utilized between the developer contained in the feed member 80 and the amount of developer in the developing container. It is possible to detect the amount of remaining developer in the developing container from such a correlation.

However, it has been found that to perform successive detection of the amount of the remaining developer in the above-mentioned developing unit might sometimes be difficult. This is because the amount of toner in the above-mentioned feed member is not stable if the speed of image formation varies.

In the following, this will be described in detail. In general, in an image forming apparatus using a non-magnetic single component developing method, in a case where a recording medium is cardboard (i.e., paper for high quality pictures generally having a weight of 100 g/m$^2$ or more) or the like, the apparatus performs an operation such that the speed of the recording medium passing a corresponding fixing unit is controlled to be slowed down for improved fixing performance. At that time, a development operation might be performed at a leading end portion of the recording medium at the time when the recording medium leading end portion begins to enter the fixing unit. In such a case, it is general to provide a plurality of so-called low-speed print modes in addition to a normal-speed print mode that corresponds to the image formation of plain paper (i.e., paper generally having a weight of about 60-80 g/m$^2$). In the low-speed print modes, the rotational speeds of the photosensitive drum, the developing roller, and the above-mentioned developer feed member (hereinafter, feed roller) are dropped, too, following the decreased speed of the recording medium. Hereinafter, in the description that the rotational speed of the feed roller has been changed, it is assumed that the rotational speed of the developing roller is also changed while keeping a constant circumferential speed ratio with respect to the feed roller. When the rotational speed of the feed roller is changed in this manner, an amount of the developer held by the feed roller and the time required until a predetermined amount of developer is held thereby are changed in accordance with the rotational speed of the feed roller.

For example, as the rotational speed of the feed roller slows relatively, the amount of the developer stored in the feed roller increases with respect to the amount of the developer in the developing container. This is because when the feed roller takes in and releases the developer in a portion thereof abutting the developing roller, a force to release the developer becomes relatively weaker than a force to take in the developer as the rotational speed of the feed roller decreases.

In addition, on the other hand, as the rotational speed of the feed roller slows, the time required when the feed roller takes in and accumulates a predetermined amount of developer, which is decided by the amount of developer in the developing container and the rotational speed of the feed roller, becomes relatively longer. This is because the rotational speed of the feed roller slows, and the frequency per unit time and the ability of the developer intake and release operations in the abutting portions of the feed roller and the developing roller decrease.

Therefore, the time required until the feed roller accumulates the developer in a stable manner at the time when the rotational speed of the feed roller changes is not uniquely decided simply by the distance the feed roller and the developing roller have moved with respect to each other.

On the contrary, when the rotational speed of the feed roller becomes relatively faster, the amount of the developer in the feed roller decreases quickly up to a predetermined amount of developer, corresponding to the amount of the developer in the developing container and the rotational speed of the feed roller.

Due to the above-mentioned phenomenon, the variation of the electrostatic capacitance becomes gentle or gradual when the speed of image formation or the rotational speed of the feed roller slows relatively as in the low-speed print modes. That is, even if the amount of the developer in the developing container is constant, the electrostatic capacitance between the feed roller and the developing roller comes to vary in a gentle or gradual manner in accordance with the rotational speed of the feed roller. Therefore, when the developer is consumed while the image formation speed is frequently changed, the above-mentioned electrostatic capacitance does not take a fixed value corresponding to the amount of the developer in the developing container. As a result, it becomes difficult to detect an amount of change in the electrostatic capacitance corresponding to the amount of remaining developer, and hence it becomes difficult to perform successive detection of the amount of remaining developer.

For this phenomenon, it is considered to take a countermeasure of providing remaining amount detection tables for the individual rotational speeds of the feed roller, respectively, for example. However, when the rotational speed of the feed roller becomes slow, it is difficult to cope with the phenomenon by taking such a countermeasure. The method might still be effective if the above-mentioned electrostatic capacitance quickly stabilizes to an electrostatic capacitance inherent to the rotational speed of the feed roller when the rotational speed becomes slow. However, in actuality, when the rotational speed of the feed roller has been changed to a low-speed side, the developer is being filled into the feed roller little by little, so the electrostatic capacitance rises in a gradual manner. Accordingly, when the rotational speed of the feed roller has been changed into a low speed, it takes a long period of time until the electrostatic capacitance becomes a fixed value, so the output value does not become stable in a short period of time. In a case where during that time, a lot of developer has been consumed or the speed change has been frequently repeated, no stable electrostatic capacitance detection output value at each speed corresponding to the consumption of the developer is obtained, and successive remaining amount detection becomes difficult.

SUMMARY OF THE INVENTION

Accordingly, the present invention has been made to solve the problems of the related art as referred to above, and has for its object to provide an image forming apparatus in which an amount of remaining developer in a developing container is detected by detecting an electrostatic capacitance between a developer feed member and a developer carrying member, and which is capable of detecting the amount of remaining developer with good accuracy even if the rotational speed of the developer feed member changes.

For the purpose of achieving the above object, an image forming apparatus having a plurality of image forming speeds includes:

an image bearing member on which an electrostatic image is formed;

a developing container that receives a developer;

a developer carrying member that is arranged to be rotatable and conveys said developer so as to develop said electrostatic image;

a developer feed member that is arranged in contact with said developer carrying member and to be rotatable, and feeds said developer to said developer carrying member;

a detection device that detects an amount of developer in said developing container by detecting an electrostatic capacitance between said developer carrying member and said developer feed member; and a control unit that changes a rotational speed of said developer feed member into a plurality of, speeds corresponding to said plurality of image forming speeds;

wherein said control unit controls the rotational speed of said developer feed member prior to the execution of a detection operation of said detection device so as to be faster than the slowest speed of said plurality of speeds.

Further features of the present invention will become apparent from the following description of exemplary embodiments with reference to the attached drawings.

DESCRIPTION OF THE EMBODIMENTS

Figure 1:
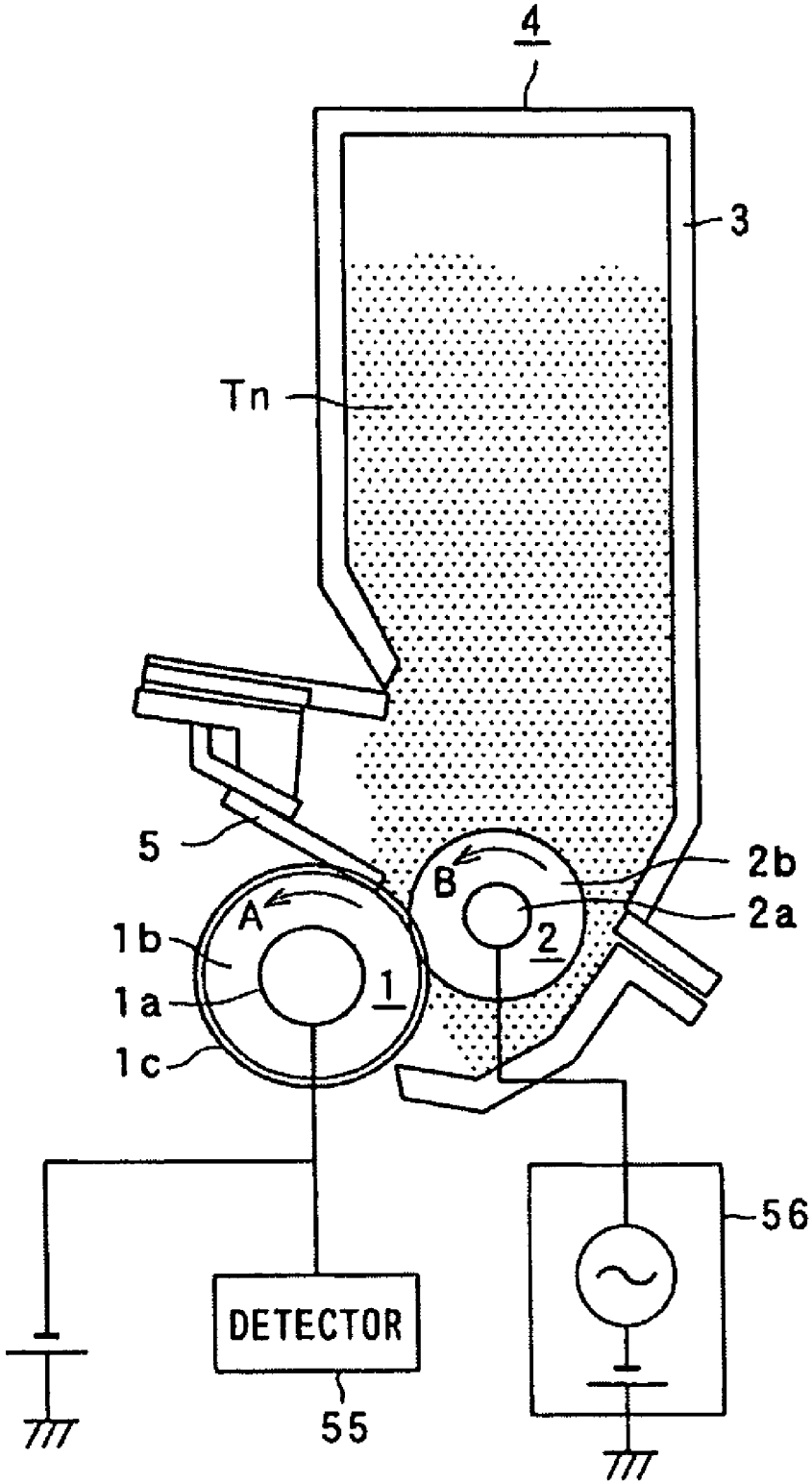
FIG. 1 depicts a developing unit according to a first embodiment of the present invention.

Hereinafter, preferred embodiments of the present invention will be described in detail, by way of example, while referring to the accompanying drawings.

However, it is to be understood that the measurements, materials, shapes, relative arrangements and the like of component parts described in the embodiments should be changed as necessary according to the construction of apparatuses and/or a variety of conditions to which the present invention is applied, and should not be construed as limiting the scope of the present invention to the embodiments which follow.

Embodiment 1

In a first embodiment, it is featured that a plurality of image forming speeds are provided (i.e., there are a plurality of image forming modes with different speeds), one of which is a developer remaining amount detection mode.

First of all, reference will be made to the schematic construction of an image forming apparatus according to this embodiment based on FIGS. 1 and 5. Specifically, this image forming apparatus is provided with a photosensitive drum 11 acting as an image bearing member, and a developing container 3 that receives a toner Tn acting as a developer. In addition, the developing container 3 is provided with a developing roller 1 that acts as a developer carrying member for carrying and conveying the toner Tn, and develops an electrostatic image formed on a photosensitive drum 11, which act as an image bearing member, to form a developer image. Also, a feed roller 2 is provided as a rotatable developer feed member for feeding the toner Tn to the developing roller 1. An amount of remaining toner Tn in the developing container 3 is detected by applying an alternating voltage between the developing roller 1 and the feed roller 2 from a detection alternating current bias power supply 56, and by detecting a voltage induced therebetween by means of a detector 55 acting as a developer remaining amount detection device. Further, a memory 23 acting as a storage device is provided for updating and storing toner remaining amount information corresponding to developer remaining amount information. The image forming apparatus of this embodiment has a developing unit 4 which acts as a process cartridge and which is detachably attachable with respect to an image forming apparatus main body 10 to be described later in detail.

Next, the above-mentioned developing unit 4 will be described in detail white referring to FIG. 1. The developing unit 4 is provided with the above-mentioned developing container 3, the developing roller 1, the feed roller 2, and a developer restriction member 5. In FIG. 1, a reference numeral 3 denotes a developing container that accommodates the toner Tn which is a non-magnetic single component developer as a developer. The developing roller 1 acting as the developer carrying member is arranged in an opening portion of the developing container 3, and is rotatably supported by the developing container 3. In addition, in the developing container 3, there are arranged the feed roller 2 that acts as the developer feed member and rotates in contact with the developing roller 1 to feed the toner Tn to the developing roller 1, and the developer restriction member 5 that has one end portion thereof being in abutment with the developing roller 1 so as to restrict the toner Tn fed to the developing roller 1 into a thin layer. The feed roller 2 functions as a detection member for detecting the amount of the developer in the developing container, as will be described later.

The negatively chargeable non-magnetic single component toner Tn is used as the developer, and the toner Tn is charged negatively by friction at the time of development, with the degree of aggregation of the toner being 15%.

The degree of aggregation of the toner was measured in the following manner. A powder tester (manufactured by HOSOKAWA MICRON, Ltd.,) having a digital vibration meter (manufactured by DEGITAL VIBLATION METER MODEL 1332 SHOWA SOKKI CORPORATION) was used as a measuring device.

As a measuring method, a sieve of 390 meshes, a sieve of 200 meshes, and a sieve of 100 meshes were stacked or superposed one over another in order of increasing mesh size from top, i.e., the sieve of 390 meshes, the sieve of 200 meshes, and the sieve of 100 meshes were placed sequentially in this order in such a manner that the sieve of 100 meshes was placed on the top.

A sample (toner) of a weight of 5 g accurately measured was placed on the sieve of 100 meshes, and the value of displacement of the digital vibration meter was adjusted to be 0.60 mm (peak-to-peak), after which vibration was applied to the sample for 15 seconds. Thereafter, the mass of the sample having remained on each sieve was measured, and the degree of aggregation was obtained based on the following expression.

The samples measured at that time were respectively left beforehand in an atmosphere of 23 degrees C. and 60% RH for 24 hours, and measurements were performed in an atmosphere of 23 degrees C. and 60% RH.

Aggregation (%)=(the mass of the remaining sample on the sieve of 100 meshes/5 g)×100+(the mass of the remaining sample on the sieve of 200 meshes/5 g)×60+(the mass of the remaining sample of 390 meshes/5 g)×20

The developing unit 4 is constructed such that the opening portion of the developing container 3 is arranged at a lower position so as to permit the weight of the toner Tn to be applied to the developing roller 1 and the feed roller 2. Such an arrangement is preferable in that the developer easily comes into the feed roller and the amount of the developer in the developing container can be detected with a high degree of accuracy.

The developing roller 1 has a core metal 1*a* and a semiconductive silicone rubber layer 1*b* which is arranged around the core metal 1*a* and is mixed with an electrically conductive material, and the developing roller 1 is constructed so as to be driven to rotate in a direction A in the figure. The core metal 1*a* having an outer diameter of 6 mm acts as an electrically conductive support member, and the semiconductive silicone rubber layer 1*b* with the electric conductive material mixed therein is arranged around the core metal 1*a*. Further, an acrylic- and urethane-based rubber layer 1*c* having a thickness of 20 μm is coated on the surface of the silicone rubber layer 1*b*. The outer diameter of the developing roller 1 as a whole is 12 mm. In addition, the developing roller 1 in this embodiment has a resistance of $1\times10^6\Omega$.

Here, a measuring method for the resistance of the developing roller 1 will be described. The developing roller 1 is placed into abutment with an aluminum sleeve of 30 mm in diameter at an abutment load of 9.8 N. By rotating this aluminum sleeve, the developing roller 1 is driven to rotate at a rotational speed of 60 rpm with respect to the aluminum sleeve. Then, a DC voltage of −50 V is impressed on the developing roller 1. At that time, a resistor of 10 kΩ is connected to a ground side of the developing roller 1, so that the resistance of the developing roller 1 is calculated by calculating a current through the resistor by measuring a voltage across the opposite ends thereof.

Here, note that when the resistance of the developing roller 1 is larger than $1\times10^9\Omega$, the voltage value of a developing bias on the surface of the developing roller 1 lowers, and a direct-current electric field in a development region decreases, so the development efficiency decreases, thus giving rise to a trouble that the image density decreases. Accordingly, it is desirable that the resistance of the developing roller 1 be set equal to or less than $1\times10^9\Omega$.

The feed roller 2 acting as a developer feed member and a developer remaining amount detection member is provided with the electrically conductive support member and a foam layer supported by the electrically conductive support member. Specifically, around the core metal 2*a* of an outer diameter of 5 mm acting as the electrically conductive support member, there is provided a urethane foam layer 2*b* that is a foam layer composed of a continuous air bubble body (i.e., continuous bubbles) having air bubbles connected with one another, and it is constructed to be driven to rotate in a direction B in FIG. 1. The outer diameter of the feed roller 2 as a whole including the urethane foam layer 2*b* is 13 mm. With the urethane of the surface layer being formed of the continuous air bubble body, a lot of toner Tn can be made to come into the interior of the feed roller 2, so it becomes possible to improve the accuracy of toner amount detection. In addition, the feed roller 2 in this embodiment has a resistance of $1\times10^9\Omega$.

Here, a measuring method for the resistance of the feed roller 2 will be described. The feed roller 2 is placed into abutment with the aluminum sleeve having a diameter of 30 mm in such a manner that an amount of penetration or push-in to be described later becomes 1.5 mm. By rotating this aluminum sleeve, the feed roller 2 is driven to rotate at a rotational speed of 30 rpm with respect to the aluminum sleeve. Then, a DC voltage of −50 V is impressed on the developing roller 1. At that time, the resistor of 10 KΩ is connected to the ground side of the developing roller 1, so that the resistance of the developing roller 1 is obtained by calculating a current through the resistor by measuring a voltage across the opposite ends thereof.

The feed roller 2 has a surface cell diameter of 50 μm-1,000 μm. Here, note that the cell diameter means an average diameter of foam cells in an arbitrary cross section, and an area of the largest foam cell is first measured from a magnified image in an arbitrary cross section, and is then converted into a diameter corresponding to a perfect circle so as to obtain the largest cell diameter. Foam cells having diameters equal to or smaller than a half of the largest cell diameter are removed as noise, and individual cell diameters are also calculated from the areas of the remaining cells. An average value of the cell diameters thus obtained is determined to provide the average diameter of the foam cells. In addition, an amount of surface air flow of the feed roller 2 is set to be 3.0 liters/minute.

Next, "the amount of surface air flow" of the feed roller 2 in this embodiment will be described in detail. In this embodiment, "the amount of air flow" is specified in such a manner that the release or delivery and intake of the toner inside and outside of the feed roller are smoothly performed, whereby the inside of the feed roller and the outside of the feed roller can be brought into an equilibrium state. The delivery and intake action of the toner, which has been mixed with air to generate a powder flow, is performed through a "surface layer" of the feed roller, and hence it is important to directly specify "an air flow amount passing through the surface layer".

Figure 2:
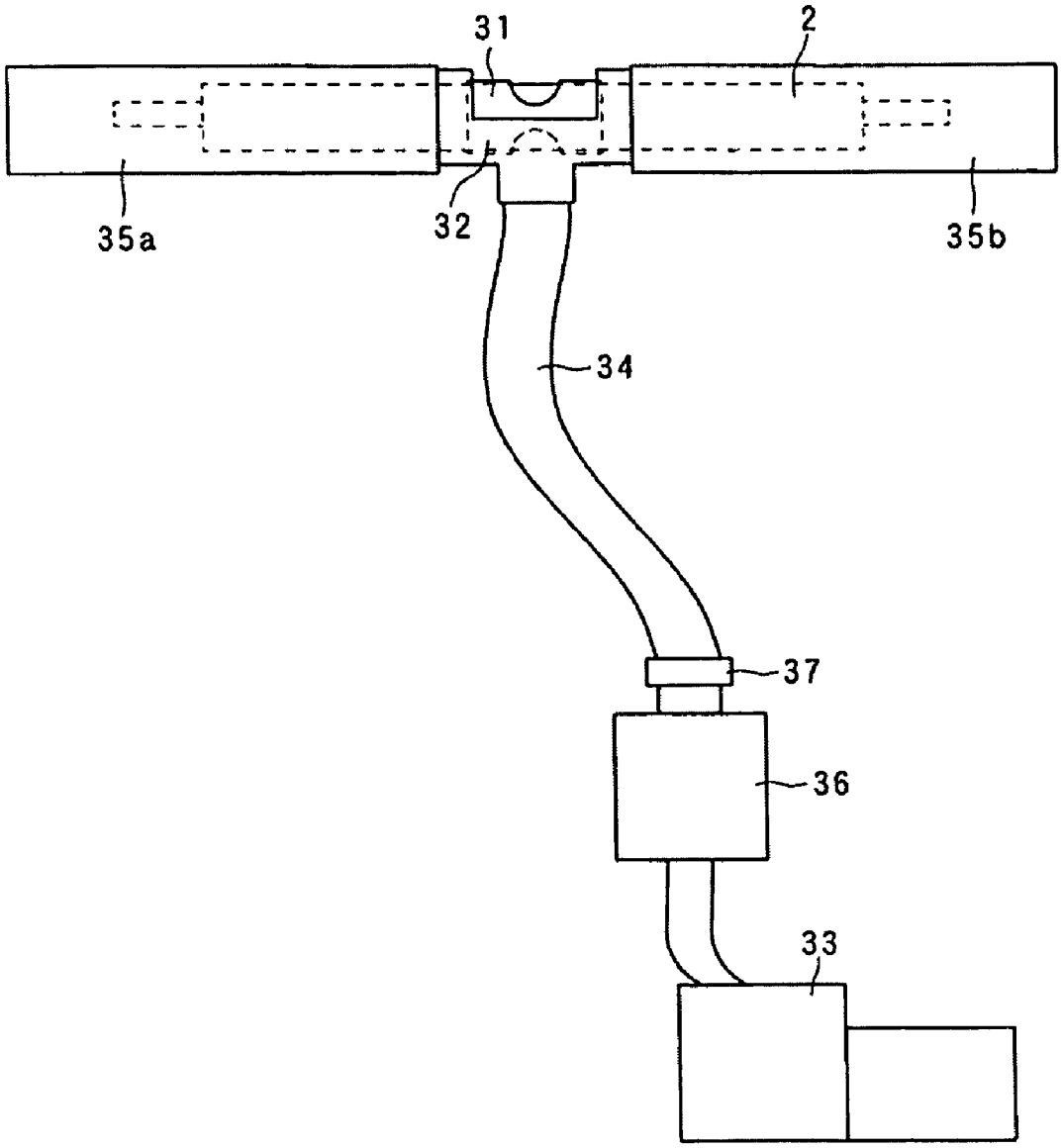
FIG. 2 is a view showing a measuring method for an amount of surface air flow used for explanation in the first embodiment of the present invention.
Figure 3:
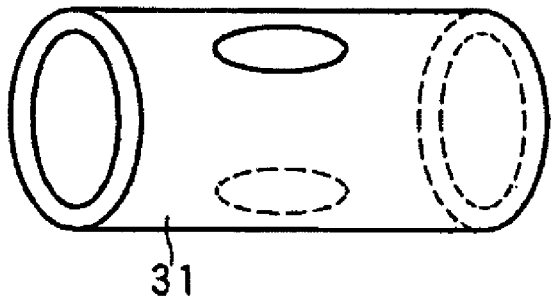
FIG. 3 is a view showing a measurement jig used when the surface air flow used for explanation in the first embodiment of the present invention is measured.

FIG. 2 is a view depicting a measuring method for "the amount of surface air flow". First of all, the feed roller 2 in this embodiment is inserted into a measuring jig 31, as shown in FIG. 3. The measuring jig 31 of FIG. 3 has a pair of through holes of a diameter of 10 mm formed through a side surface of the hollow cylindrical body, and it is constructed such that the through holes have a common central axis arranged orthogonal to an axis of the hollow cylindrical body. The hollow cylindrical body has an inner diameter that is smaller by 1 mm than the outer diameter of the feed roller 2 to be measured. The purpose of this is to eliminate a gap between the inner surface of the cylindrical body of the measuring jig 31 and the feed roller 2 to be measured. Since the feed roller 2 of this embodiment has the outer diameter of 13 mm, the inner diameter of the measuring jig 31 is 12 mm.

Figure 4:
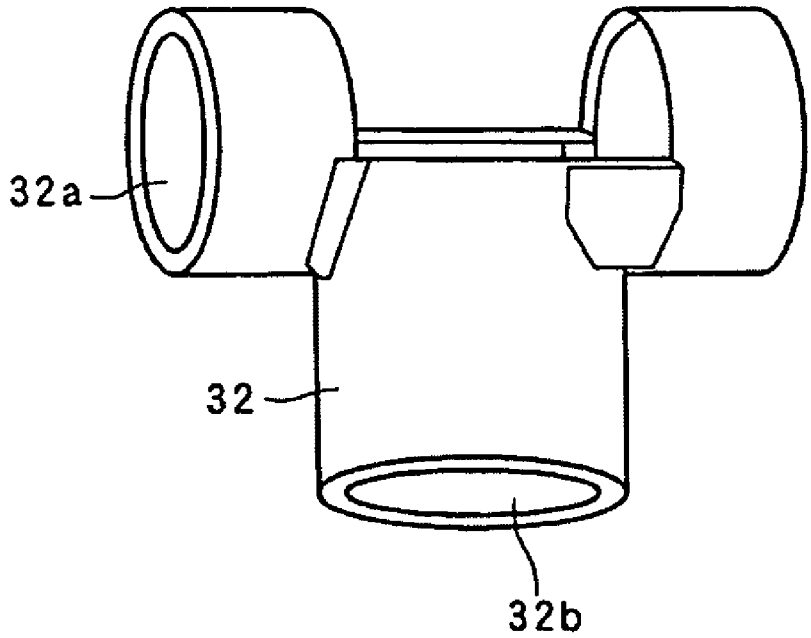
FIG. 4 is a view showing a vent holder used when the amount of surface air flow used for explanation in the first embodiment of the present invention is measured.

The measuring jig 31 with the feed roller 2 inserted therein mounted on a vent holder 32 which is shown in FIG. 4. The vent holder 32 takes a T shape in which a connection pipe 32*b* adapted for attachment of a vent pipe 34 leading to a decompression pump 33 is coupled to the side surface of the hollow cylindrical body 32*a*. The vent holder 32 is shaped such that it is cut away to a large extent in a portion thereof on the opposite side of that portion to which the connection pipe 32*b* is coupled. The inner diameter of the connection pipe 32*b* is set to be larger than the diameter of each of the through holes in the measuring jig 31. In this embodiment, the inner diameter of the connection pipe 32*b* is set to 12 mm. The inner diameter of the hollow cylindrical body 32*a* of the vent holder 32 is substantially the same as an outside diameter of the measuring jig 31, and the measuring jig 31 can be inserted to the hollow cylindrical body 32*a*. As shown in FIG. 2, the measuring jig 31 is arranged in such a manner that one of the through holes is fully exposed to the cut-away or notched portion of the hollow cylindrical body 32*a* and the other through hole is positioned substantially in exact opposition to the inner diameter of the connection pipe 32*b*.

A pair of acrylic pipes 35*a*, 35*b* with their one closed end connected to the hollow cylindrical body 32*a*, as shown in FIG. 2, are arranged at the left and right sides, respectively, of the hollow cylindrical body 32*a* of the vent holder 32. Those portions of the feed roller 2 which extend from the right and left sides of the measuring jig 31 are received in the acrylic pipes 35*a*, 35*b*, respectively.

A flow meter 36 (KZ type air flow measuring instrument manufactured by DAIEI KAGAKU SEIKI MFG. CO., LTD) and a differential pressure control valve 37 are arranged on the vent tube 34.

When the inside of the vent tube 34 is evacuated by means of the decompression pump 33, air is prevented from flowing in except from the exposed through hole in the measuring jig 31. That is, the connecting portions of the measuring jig 31, the vent holder 32, the vent tube 34, and the acrylic pipes 35*a*, 35*b* are hermetically sealed with tape, grease, or the like.

The measurement of "the amount of surface air flow" is performed as follows. First of all, in FIG. 2, the decompression pump 33 is operated with the feed roller 2 being not installed, and measurements of the flow meter 36 are adjusted so as to be 10.8 liters/minute in a stable manner by means of the differential pressure control valve 37. After this, the feed roller 2 to be measured is installed, and sealing is made carefully as stated above, and then, under the same evacuation condition as stated above, measurements of the flow meter 36 are-made to provide "an amount of surface air flow". Of course, as "the amount of surface air flow", there is taken a measured value of the flow meter 36 at the time when the measurements of the flow meter 36 have become stable to a sufficient extent.

The air flow passing through the feed roller 2 flows into the urethane foam layer 2*b* from the surface thereof located in the exposed through hole of the measuring jig 31. Then, the air flow passes through the interior of the urethane foam layer 2*b* and flows out from the surface of the urethane foam layer 2*b* located in the other through hole of the measuring jig 31.

The surface of the urethane foam layer 2*b* of the feed roller 2 generally used is often different from the interior of the urethane foam layer 2*b*. For example, in a case where the feed roller 2 is foam-formed in a mold, there might appear on the surface of the feed roller 2 a skin layer in which the aperture ratio of surface cells thereof is different from that of the interior thereof. In addition, the surface of the urethane foam layer 2*b* might not sometimes be formed as a simple cylinder surface, but can have irregularities intentionally formed thereon. A toner granule, which comes into and out of the urethane foam layer 2*b*, can sometimes be influenced by the above-mentioned surface condition, so the behavior of the toner granule can not be captured in an accurate manner only by measuring the rate of a bulk air flow such as, for instance, JIS-L1096. Accordingly, in this embodiment, there is adopted an air flow rate measuring method for measuring the rate of air flow that comes in and out from the surface of the urethane foam layer 2*b*, as described above, and the air flow rate thus measured is taken as a main parameter that creates an equilibrium state (or a nearby state) of the above-mentioned toner granule.

The developing roller 1 and the feed roller 2 are constructed such that the former is driven to rotate in a direction of A in FIG. 1, and the latter is driven to rotate in a direction of B, respectively, with the distance between the respective centers of rotation of the developing roller 1 and the feed roller 2 being set to be 11 mm. In this regard, the above-mentioned urethane foam layer 2*b* is sufficiently softer than that of the silicone rubber layer 1*b* and the acrylic- and urethane-based rubber layer 1*c*, so the surface of the developing roller 1 is in contact with the feed roller 2 in a state where the urethane foam layer 2*b* of the feed roller 2 is crushed by a maximum amount of 1.5 mm. The maximum amount of crush is the largest distance between the position of the surface of the urethane foam layer 2*b* when the urethane foam layer 2*b* and the developing roller 1 are out of contact with each other, and the position of the surface of the urethane foam layer 2*b* in normal use where the developing roller 1 is placed in contact with the urethane foam layer 2*b*. This maximum amount of crush is referred to as an amount of penetration or push-in of the developing roller 1 with respect to the feed roller 2.

The urethane foam layer 2*b* is crushed in its contact portion with the developing roller 1 in accordance with the rotation of the developing roller 1 and the feed roller 2. At this time, the toner Tn held on the surface or in the interior of the urethane foam layer 2*b* of the feed roller 2 is released or delivered from the surface of the urethane foam layer 2*b*, and a part of the toner Tn thus delivered transfers to the surface of the developing roller 1. The toner Tn having transferred to the surface of the developing roller 1 is uniformly restricted or distributed on the developing roller 1 by means of the developer restriction member 5 that is arranged in contact with a portion of the developing roller 1 downstream of the above-mentioned contact portion of the urethane foam layer 2*b* in the rotational direction of the developing roller 1. In the above-mentioned process, the toner Tn acquires a desired amount of triboelectrification charge (negative charge in this example) by being slidingly rubbed with contact portions of the developing roller 1 and the feed roller 2 and with the developing roller and a restriction portion of the developer restriction member 5. In addition, as shown in FIG. 1, the toner remaining on the developing roller 1 after development is scraped off and removed by the feed roller 2 in accordance with the rotation of the contact portions of the developing roller 1 and the feed roller 2 in the opposite directions with respect to each other.

Next, reference will be made to the operation of this embodiment when the developing unit is fitted to the image forming apparatus white using FIG. 5. FIG. 5 is a schematic cross sectional view of the image forming apparatus main body 10 provided with the developing unit to which the present invention is applied.

Figure 5A:
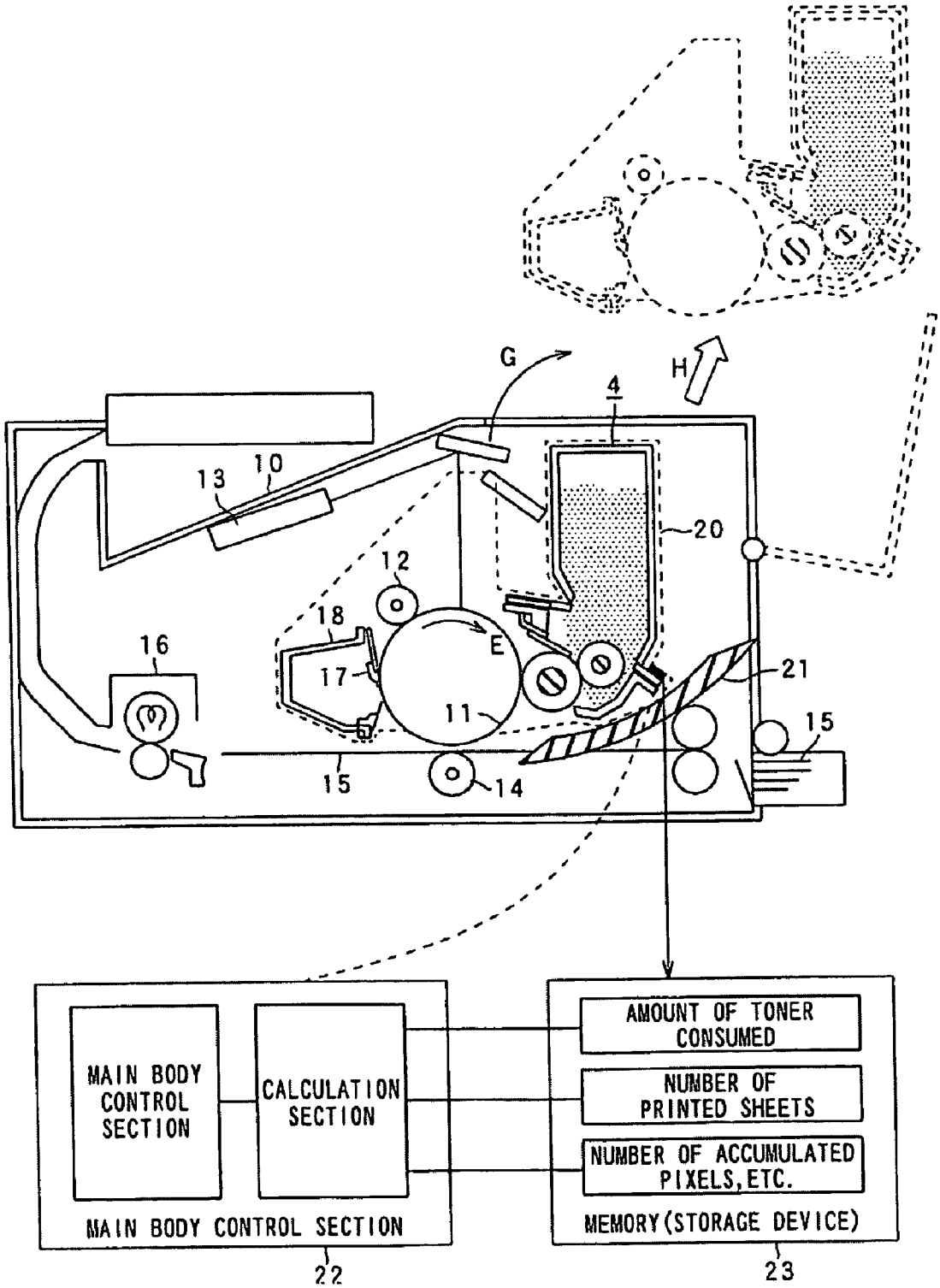
FIG. 5A depicts a developing unit and an image forming apparatus according to the first embodiment of the present invention.

In FIG. 5A, the photosensitive drum 11 acting as an image bearing member rotates in a direction denoted by arrow E. First of all, the photosensitive drum 11 is negatively electrified in a uniform manner by a charging roller 12 that is a charging device. Thereafter, the photosensitive drum 11 is exposed by a laser beam from a laser optical device 13 that acts as an exposure device, whereby an electrostatic latent image is formed on the surface of the photosensitive drum 11.

This electrostatic latent image is developed by the developing unit 4, so that it is visualized as a toner image. In this embodiment, the toner is adhered to the exposed portion of the photosensitive drum 11, and is inverted and developed.

The visualized toner image on the photosensitive drum 11 is transferred to the recording medium 15, which acts as a transfer material, by means of a transfer roller 14. The toner remaining on the photosensitive drum 11 without being transferred is scraped off and removed by a cleaning member in the form of a cleaning blade 17, so that it is received into a waste toner container 18. The photosensitive drum 11 thus cleaned performs image formation while repeating the above-mentioned operation. On the other hand, the recording medium 15 with the toner image being transferred thereto is permanently fixed by means of a fixing unit 16, and is then discharged to the outside of the apparatus.

In this embodiment, the developing unit 4 is provided as a process cartridge 20 that is constructed integrally with the photosensitive drum 11, the charging roller 12, the cleaning blade 17, the waste toner container 18. The process cartridge 20 can be made attachable to and detachable from the image forming apparatus main body 10 by the user opening an opening and closing a window at an upper location of the image forming apparatus in a direction of G in FIG. 5A, and drawing out the process cartridge 20 in a direction of H in FIG. 5A along a guide 21 in the image forming apparatus. In addition, a storage device in the form of the memory 23 is arranged in the process cartridge in the form of the developing unit 4. As the memory 23, there can be used any arbitrary form of memory such as, for example, a contact nonvolatile memory, a contactless nonvolatile memory, a volatile memory having a power supply, etc. In this embodiment, the memory 23 in the form of a contactless nonvolatile memory is installed on the developing unit 4 which serves as the process cartridge. The contactless nonvolatile memory 23 has an antenna (not shown) which acts as an information transmission device at the memory side, whereby the memory 23 can communicate with a CPU 22 in the image forming apparatus main body 10 through wireless or radio communications so as to enable information to be read out therefrom and written thereinto.

Specifically, in this embodiment, the CPU 22 is provided with a control section, a calculation section, a storage section (ROM), a clock, etc., and in addition, has a function of reading and writing information from and into the memory 23 through an information transmission device at the apparatus main body side. In the memory 23, there are stored at least an amount of developer consumed that is obtained by the detection of the amount of remaining developer, the number of sheets of image formation (print), and/or the number of counts of individual image signals (the number of counts of pixels) that form the dots of the image in the image formation. Details will be described later.

The amount of the developer consumed can be estimated from the number of sheets of images and the number of counts of pixels to a certain extent, and is used as an index for deciding the timing at which a remaining amount detection sequence to be described later is executed. Here, one example of a method for counting the number of pixels will be described. The pixel counting is to count individual image signals that form the image dots (hereinafter referred to as dots) of an image formed. The image forming apparatus according to this embodiment is a laser beam printer of 600 dpi (dots/inch) as one example. In addition, an image formable area of letter size paper (216 mm×279 mm) is 204 mm×269 mm, and is 4,878 dots×6,420 dots in terms of dots. Accordingly, one page of the transfer material is divided into regions of 40×60=2,400. Each region has a size of about 5.1 mm×4.5 mm (122 dots×107 dots).

In this embodiment, image data that is print output from a host computer is sent to the CPU 22 as electric signals. The image data may be one that is sent from an image readout section or the like provided in the image forming apparatus main body, for example. The CPU 22 converts this image data into a video signal per line and produces a laser drive signal in accordance with the video signal. Then, with the laser drive signal, the CPU 22 controls the turning on and off of a laser unit (not shown) so that the photosensitive drum 11 can be irradiated by the laser unit. A horizontal synchronization signal (BD signal) comes to the head of a scanning line when the video signal is sent to the laser unit while being converted into the laser drive signal for causing laser emission. Since the video signal comes after a fixed period of time from the BD signal, the start position of the video signal can be checked by detecting the BD signal.

The counting of dots in each region is started from zero at a predetermined interval, and the result of each count is sent to an unillustrated dot number storing memory, and is stored there for each region counted. Thus, the number of dots in the laser scanning direction in each region can be counted. In addition, the number of scanning lines can be known by counting BD signals. The number of dots in each region 1s counted in this manner, and is stored in the dot number storing memory. The number of sheets of image formation stored in the memory 23 is employed as information now used in this embodiment.

In this embodiment, a DC voltage of −1,000 V is impressed on the charging roller 12 to charge the surface of the photosensitive drum 11 to a potential of about −500 V. This potential is referred to as a dark space potential Vd. For a predetermined period of time, the developing unit 4 maintains the photosensitive drum 11 and the developing roller 1 in a mutually separated state, as shown in FIG. 5C. A cam 42 having a cam surface is provided on the main body of the image forming apparatus and can be driven to rotate by means of a drive device (unillustrated) and a drive transmission unit (unillustrated) which are arranged in the main body of the image forming apparatus, but at this time, the cam 42, being in a separated position B, pushes a predetermined position of a rear surface of the developing unit 4.

The developing unit 4 is provided with a force receiving portion 43 that is adapted to receive a force capable of moving the developing container 3 to a first position in which a developing operation is carried out by the developing roller 1, and a second position in which no developing operation is carried out. The force receiving portion 43 is arranged in the above-mentioned predetermined position on the rear surface of the developing unit 4 or the process cartridge. The force receiving portion 43 has various performances such as a sufficient surface sliding performance required when being caused to rotate in contact with the cam 42, a sufficient degree of hardness with which the force receiving portion 43 is not deformed even in the separated state in which a maximum force is applied thereto in this embodiment, etc.

In accordance with the rotation operation of this cam 42, the cam surface of the cam 42 pushes the force receiving portion 43 of the process cartridge, whereby the developing unit 4 is caused to rotate about an axis of rotation in the form of a center of swing 40, while-overcoming a reactive force of a push spring 41 arranged between the developing unit 4 and the waste toner container 18. By the swing motion of the developing roller 1, the developing roller 1 is caused to move from a contact position (FIG. 5B) to the separated position (FIG. 5C) with respect to the photosensitive drum 11.

A posture position of the developing unit 4 in which the developing roller 1 is placed in contact with the photosensitive drum 11 is referred to as a first position (development position), and a posture position of the developing unit 4 in which the developing roller 1 is placed out of contact with the photosensitive drum 11 is referred to as a second position (non-development position). Of course, in the second position, no development operation is carried out.

After the potential Vd of the photosensitive drum 11 becomes stable, the photosensitive drum 11 is exposed by a laser beam from the laser optical device 13, which is the exposure device, whereby an electrostatic latent image is formed on the surface of the photosensitive drum 11. A surface potential of an exposed region of the photosensitive drum 11 is about −100 V. This potential is referred to as a bright space potential V1. In addition, at a predetermined timing, the developing roller 1 and the feed roller 2 start to be driven to rotate for preparation for a subsequent development process of an electrostatic latent image by means of the drive device (unillustrated) and the drive transmission unit (unillustrated) that are arranged in the main body of the image forming apparatus.

Figure 5B:
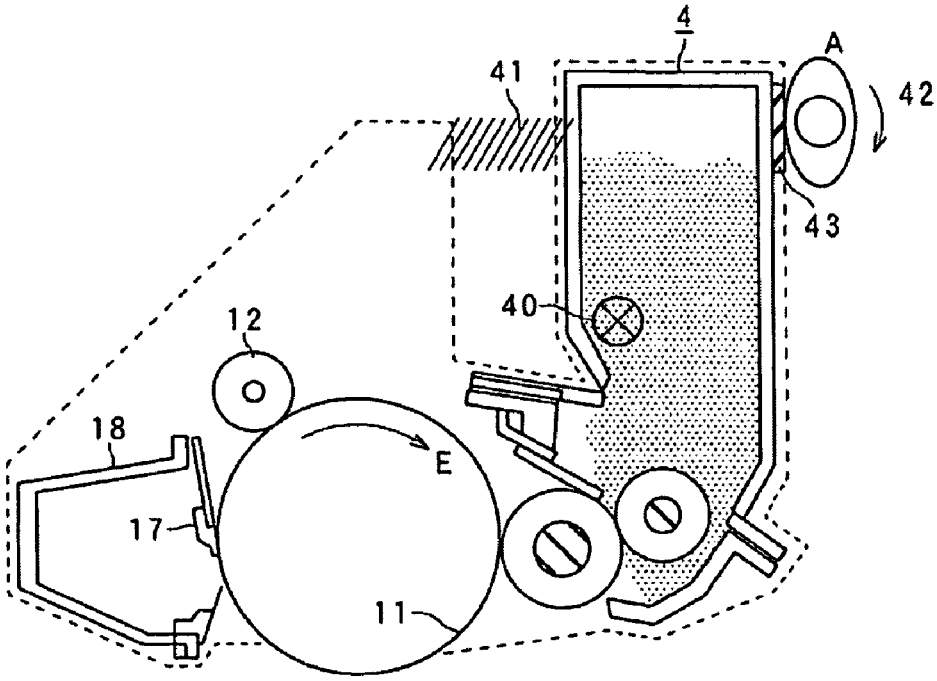
FIG. 5B depicts the developing unit and the image forming apparatus according to the first embodiment of the present invention.
Figure 5C:
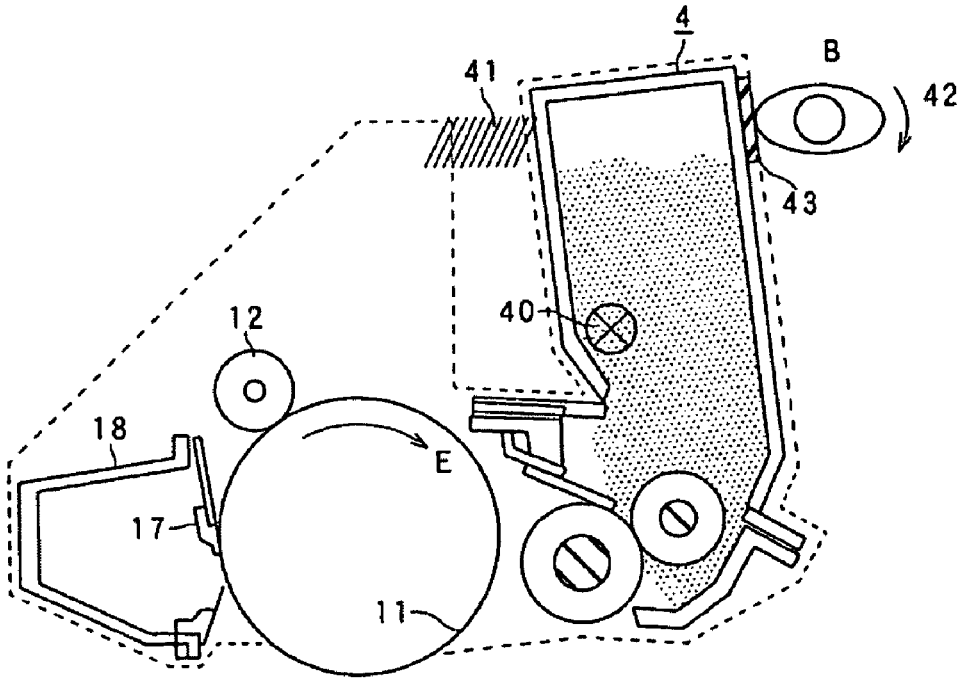
FIG. 5C depicts the developing unit and the image forming apparatus according to the first embodiment of the present invention.

The cam 42 is driven to rotate to the posture of position A, as shown in FIG. 5B, by means of the drive device arranged in the image forming apparatus main body, so that the developing unit 4 takes the development position. In the position A, the force pushing the force receiving portion 43 on the rear surface of the developing unit 4 is released. Therefore, the developing unit 4 is caused to rotate around the axis of rotation in the form of the center of swing 40 by the force of the push spring 41 arranged between the developing unit 4 and the waste toner container 18, whereby the developing roller 1 is placed into abutment with the photosensitive drum 11 (FIG.

5B). At this time, a DC voltage of −300 V is impressed on the developing roller 1 as a developing bias at a predetermined timing.

The first position of the developing unit 4 is a position in which the developing roller 1 and the photosensitive drum 11 is placed in abutment with each other to develop the electrostatic latent image formed on-the photosensitive drum 11.

After the completion of the development of the electrostatic latent image, the cam 42 is caused to rotate to the position B, again. As a result, the cam 42 pushes the force receiving portion 43 on the rear surface of the developing unit 4, whereby the developing unit 4 is caused to rotate about the center of swing 40 which acts as the axis of rotation. With the rotation of the developing unit 4, the developing roller 1 is caused to move away from the photosensitive drum 11, white overcoming the reactive force of the push spring 41 arranged between the developing unit 4 and the waste toner container 18. In other words, the developing unit 4 is caused to move to the second position, again.

At the same time, the rotational driving of the developing roller 1 and the feed roller 2 is stopped, and impressing the developing bias on the developing roller 1 is also stopped.

In this embodiment, in the second position (FIG. 5C) in which the developing roller 1 is separated from the photosensitive drum 11, the electrostatic capacitance between the developing roller 1 and the feed roller 2 can be detected, so the detection of the amount of remaining toner in the developing unit 4 is carried out.

Now, reference will be made to the developer remaining amount detection method by making use of a change in the electrostatic capacitance in this embodiment while using FIG. 6 and FIG. 7.

Figure 6:
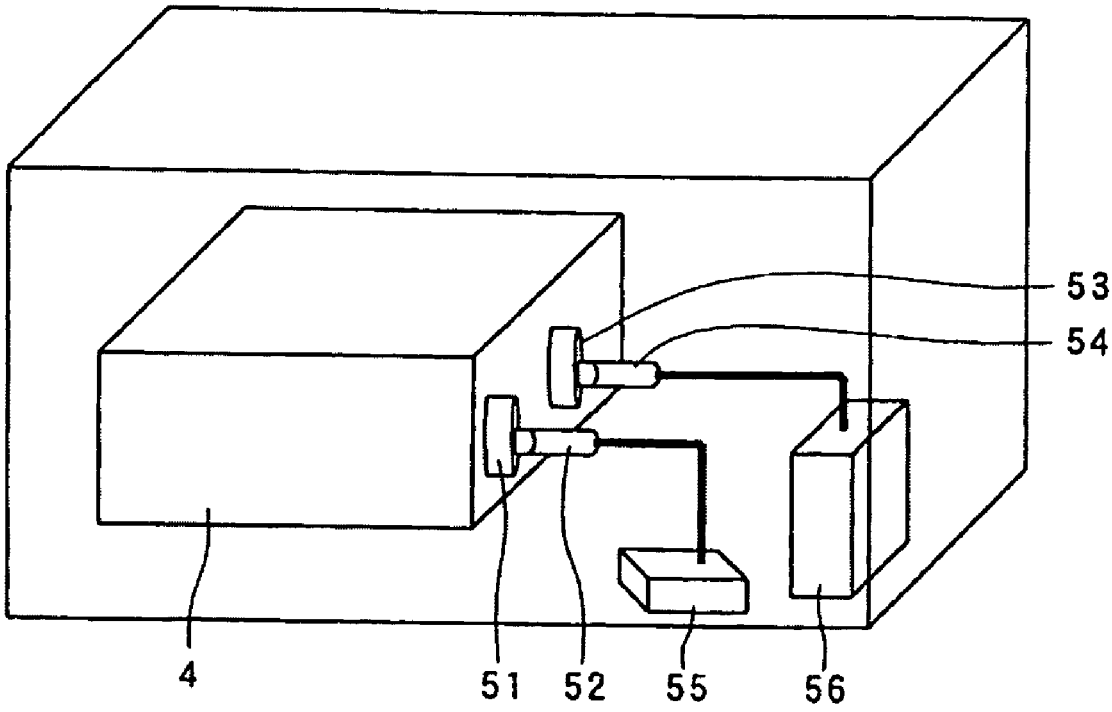
FIG. 6 depicts a developer remaining amount detection method for the developing unit used for explanation in the first embodiment of the present invention.

FIG. 6 represents a state in which the developing unit 4 of this embodiment is installed in the image forming apparatus main body 10, wherein a reference numeral 51 denotes a contact electrode which is attached to the developing unit 4 and is conductively connected to the core metal 1*a* of the developing roller 1. A reference numeral 52 denotes a contact electrode that is arranged at the side of the main body 10 of the image forming apparatus so as to correspond to the contact electrode 51, and the contact electrode 52 is connected to the detector 55 in the interior of the main body 10 of the image forming apparatus.

Similarly, provision is made for a contact electrode 53 which is attached to the developing unit 4 and is conductively connected to the core metal 2*a* of the feed roller 2, and a corresponding contact electrode 54 which is arranged at the side of the image forming apparatus main body 10, and which is connected to a detection alternating current bias power supply 56 in the interior of the image forming apparatus main body 10. In a state in which the developing unit 4 is installed in the predetermined position inside the image forming apparatus main body 10, the contact electrodes 51, 52 are in conduction to each other both at the first position in which the developing roller 1 and the photosensitive drum 11 are placed in abutment with each other, and at the second position in which the developing roller and the photosensitive drum 11 are separated from each other. Also, the contact electrodes 53, 54 are in conduction to each other, too.

The contact electrode 51 and the contact electrode 52 as well as the contact electrode 53 and the contact electrode 54 remain in contact with each other even if the developing unit 4 is caused to swing to the first position and the second position. At the time of a normal developing operation, the developing unit 4 is in the first position where the developing bias (DC voltage) is impressed on the contact electrode 51 through the contact electrode 52. At this time, the same voltage as the developing bias is impressed on the contact electrode 53 through the contact electrode 54. That is, during the developing operation, the contact electrode 51 and the contact electrode 53 become the same potential, so no electric field is formed between the developing roller 1 and the feed roller 2. Thus, during the developing operation, the detector 55 and the detection alternating current bias power supply 56 are switched over to a developing bias power supply.

Figure 7:
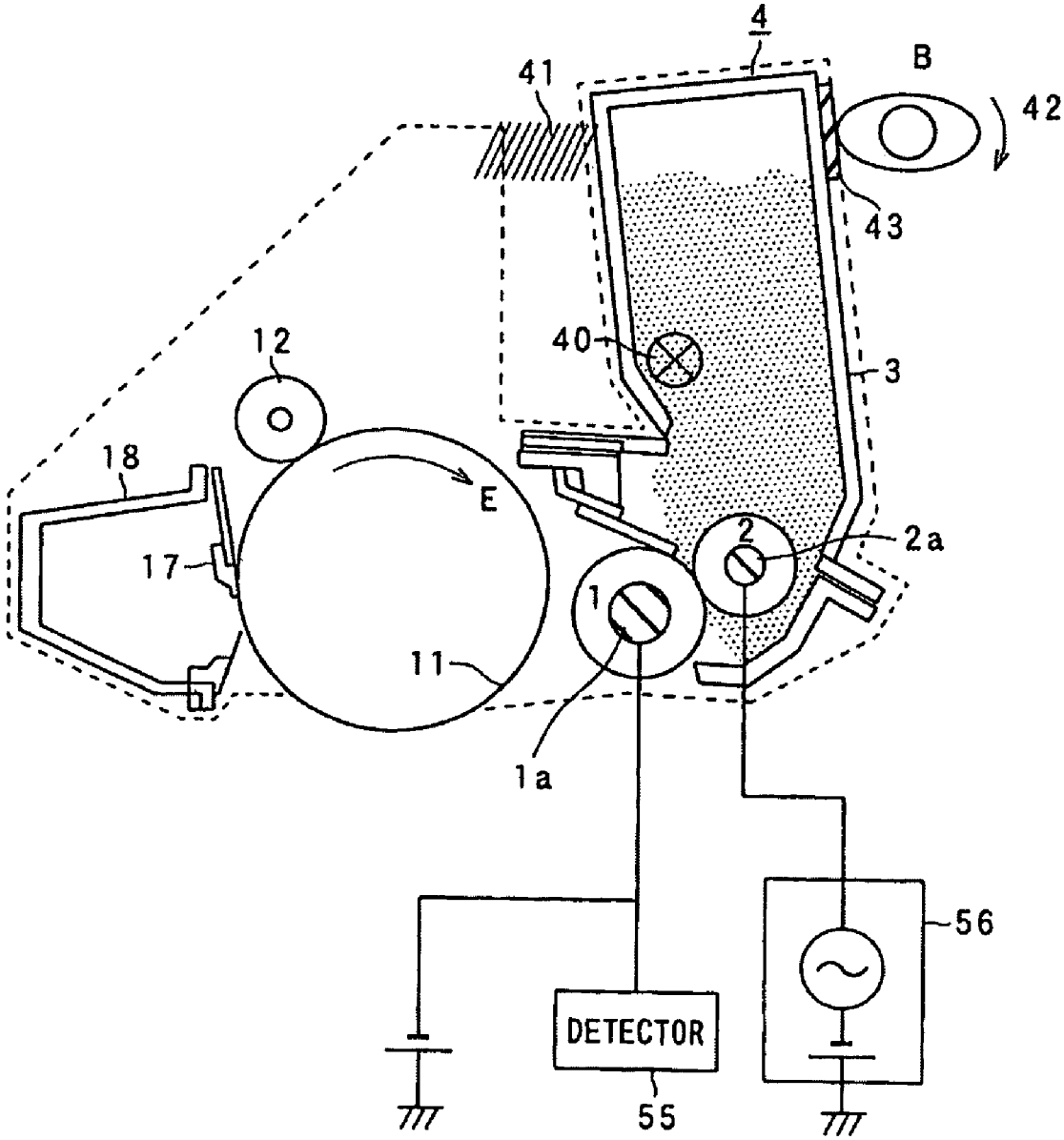
FIG. 7 depicts the developer remaining amount detection method for the developing unit used for explanation in the first embodiment of the present invention.

Subsequently, as shown in FIG. 7, during a non-developing operation, the developing unit 4 takes the second position where in this embodiment, an alternating voltage acting as a toner remaining amount detection bias is impressed on the electrically conductive core metal 2*a* of the feed roller 2 from the bias power supply 56. Then, the amount of remaining toner in the developing unit 4 is detected. An alternating current bias having a frequency of 50 KHz and a voltage of Vpp=200 V is used as the toner remaining amount detection bias.

On the electrically conductive core metal 1*a*, there is induced by the toner remaining amount detection bias a voltage, which is detected by the detector 55 that constitutes a toner remaining amount detection device. What is detected by the detector 55 is a voltage that has a fixed relation to the electrostatic capacitance between the developing roller 1 and the feed roller 2, so the electrostatic capacitance can be detected by detecting the voltage.

The second position in which no developing operation is performed, i.e., a state in which the photosensitive drum 11 and the developing roller 1 are separated from each other, is taken at the time of non-developing operation. Specifically, such a time or state can be achieved between sheets of paper on which no image formation is performed, or in an operation of the apparatus (so-called post-rotation operation) during the time when the recording medium 15 is discharged to the outside from the image forming apparatus after an image forming process is completed, or the like.

Since at this time, in the second position, the photosensitive drum 11 and the developing roller 1 are separated from each other, even if the alternating current bias is impressed on the feed roller 2 as the toner remaining amount detection bias, there will be generated no smear on a white background called fog on the photosensitive drum 11. In addition, there will be generated no unpleasant impact or striking sound at the time when the developing roller 1 and the photosensitive drum 11 beat with each other to produce vibrations while being placed in contact with each other.

The developing roller 1 is used as an antenna for the detection of electrostatic capacitance by impressing the alternating current bias on the electrically conductive core metal 2*a* of the feed roller 2 for the purpose of detecting the amount of remaining toner therefrom. As a result, it is possible to prevent a hindrance to the conveyance of the toner which would otherwise occur in the construction that a separate dedicated antenna is arranged in a developing chamber.

Of course, the posture of the developing unit 4 changes in accordance with abutment and separation operations of the photosensitive drum 11 and the developing roller 1, i.e., between the first position in which a developing operation is performed and the second position in which no developing operation is performed, as shown in FIG. 5B and FIG. 5C. Accordingly, the toner will be caused to move, too.

At this time, in the developing unit 4 of this embodiment, a voltage induced on the developing roller 1 is detected by impressing an alternating current bias on the electrically conductive core metal 2*a* of the feed roller 2 so as to detect the amount of remaining toner therefrom, and by using the developing roller 1 as an antenna for the detection of electrostatic capacitance. Thus, the capacitance change of the toner contained in the feed roller 2 is measured. Accordingly, the amount of the toner contained in the feed roller 2 is not changed even by the posture of the developing unit 4, i.e., the movement of the toner Tn according to the abutment and separation operations. In other words, the amount of the toner Tn lying between the developing roller 1 and the antenna (the feed roller 2) does not change. As a result, there is no change in the voltage output induced on the antenna. That is, the feed roller 2 is provided with the foam layer the interior of which the toner can come into, so the toner in the foam layer is difficult to move even if the posture of the developing unit 4 changes, as a result of which there is no change in the voltage output.

Additionally, in the non-magnetic one-component contact developing unit 4 of this embodiment, when the remaining amount of electrostatic capacitance is detected, i.e., in a state where the developing roller 1 and the photosensitive drum 11 are separated from each other, the rotational driving of the developing roller 1 and the feed roller 2 is stopped.

The supply of toner to the developing roller 1 and the scraping action on the undeveloped toner are interrupted by stopping the driving of the developing roller 1 and the feed roller 2. As a result, the amount of the toner contained in the feed roller 2 becomes constant during the toner remaining amount detection, thereby making it possible to enhance the accuracy of the toner remaining amount detection.

Figure 8:
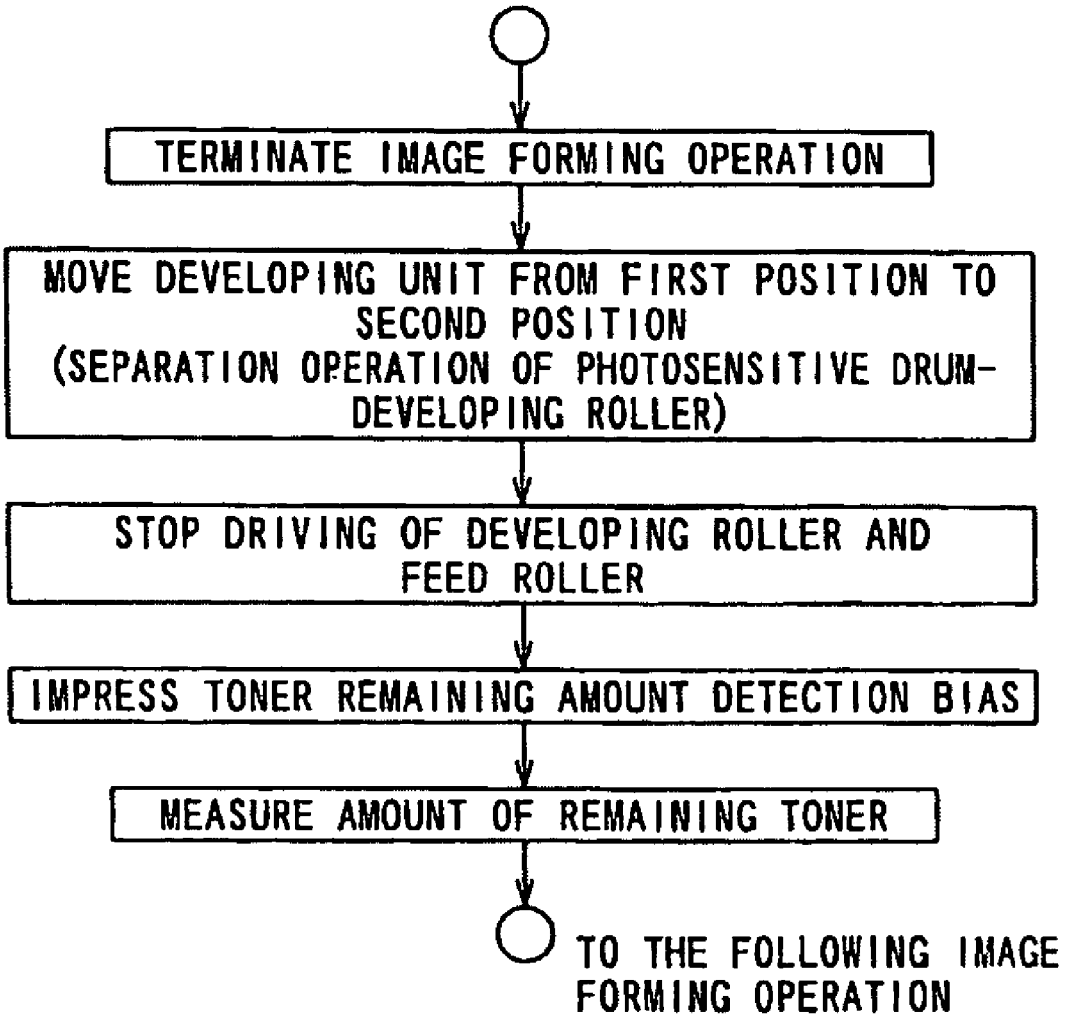
FIG. 8 is a flowchart for developer remaining amount detection of the developing unit used for explanation in the first embodiment of the present invention.

FIG. 8 depicts a flowchart for the toner remaining amount detection of this embodiment. The timing of the toner remaining amount detection is set as follows. After the completion of the image forming operation, the developing unit 4 is driven to move from the first position to the second position, whereby a separation operation between the photosensitive drum 11 and the developing roller 1 is carried out, and the driving of the developing roller 1 and the feed roller 2 is stopped. Thereafter, the amount of remaining toner is detected by impressing the toner remaining amount detection bias on the feed roller 2.

Figure 9:
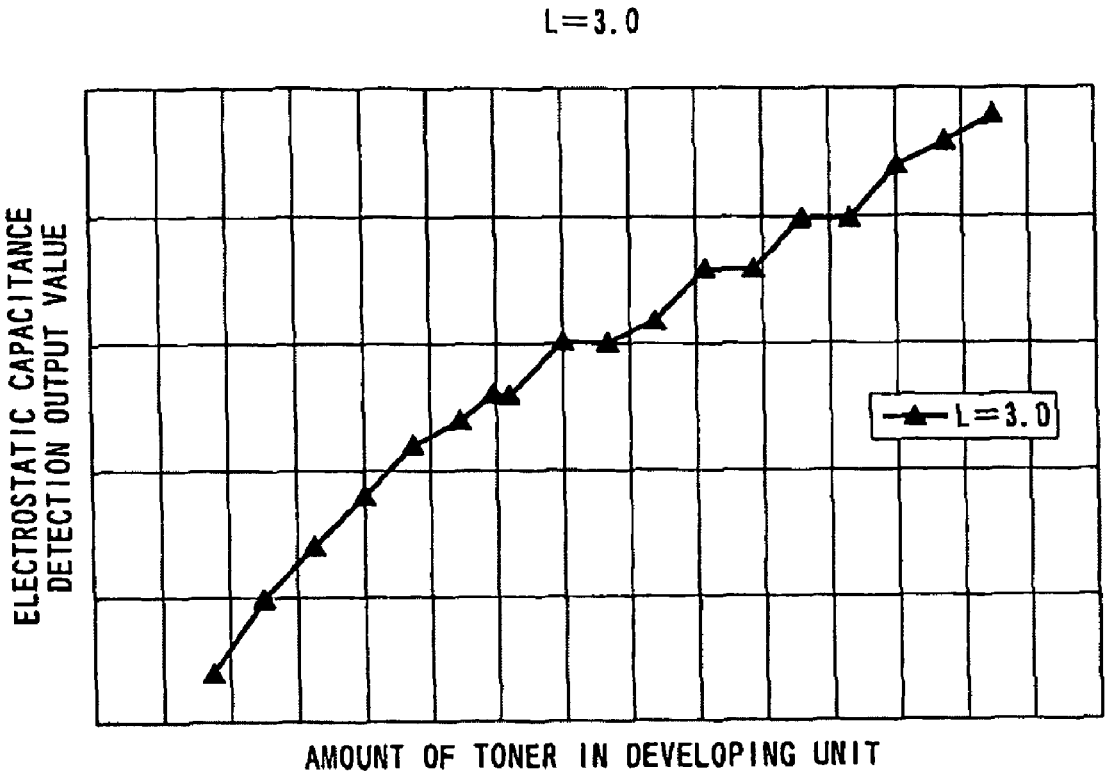
FIG. 9 is a graph showing the relationship between the amount of toner in the developing unit and the electrostatic capacitance detection output value used for explanation in the first embodiment of the present invention.

FIG. 9 depicts the output value of an electrostatic capacitance detection device 29, by means of triangle points and a solid line, in a case where the toner Tn filled into the developing unit 4 of this embodiment is being consumed in a gradual manner. In this embodiment, an amount of surface air flow L of the feed roller 2 is set to be 3.0 liters/minute. The measurement environment is 23 degrees C., and 60% Rh. As shown in FIG. 9, in the construction of the developing unit 4 of this embodiment, the remaining amount of the toner Tn in the developing unit 4 and the output value of the electrostatic capacitance detection device 29 change relatively linear while having relatively linear and good correlation therebetween.

In an indication of the amount of toner, a reference value is provided, and measured values of the electrostatic capacitance obtained from the output voltage of the detector 55 are compared with the reference value. When a measured value of the electrostatic capacitance is less than the reference value, it is determined that the toner is absent. In the image forming apparatus of this embodiment, the electrostatic capacitance detection output value from the detector 55 is replaced with numeric data of 8 bits. The output value at the time when the amount of the developer in the developing container is 100% (full) is written and held in the memory 23 through the CPU 22. In addition, the output value when the developer is being decreased as the image formation operation is performed is successively written into the memory 23. Further, developer remaining amount ratios (i.e. ratios of the measured toner amounts to the full toner amount) are calculated in succession from an amount of change of the output value ΔE ranging from 100% to 0% of the amount of developer beforehand set in the main body control section, and are written and held in the memory 23.

In the image forming apparatus main body 10 in this embodiment as described above, in case where the recording medium is cardboard or the like (in general, high quality dedicated paper of 100 g/m$^2$ or more), an operation is carried out such that the speed of the recording medium passing through the fixing unit 16 is slowed down so as to enhance its fixing ability. In that case, the rotational speeds of the photosensitive drum 11, the developing roller 1, and the feed roller 2 are also slowed down following the decreased speed of the recording medium;

The rotational speed setting condition for the feed roller 2 in the image forming apparatus main body 10 will be described below. The feed roller 2 rotates in the above-mentioned direction at a speed of 150 rpm (hereinafter 1/1 speed) as a normal speed print mode. In addition, the speed of the feed roller 2 can be changed to 75 rpm (hereinafter ½ speed), i.e., a half of the normal print speed, and 50 rpm (hereinafter ⅓ speed), i.e., one third of the normal print speed, all of which are low speed print modes. In addition, the developing roller 1 rotates in the above-mentioned direction while keeping a circumferential speed difference of 90% with respect to the feed roller 2. Hereinafter, in the description that the feed roller 2 is driven to rotate, it is meant that the developing roller 1 also rotates at the same time while keeping the above-mentioned predetermined circumferential speed ratio with respect to the feed roller 2.

That is, in the rotation operation of the developing roller 1 and the feed roller 2, there are a plurality of (e.g., three in this embodiment) rotational speed modes in which these rollers are caused to rotate at different rotational speeds. These plurality of rotational speed modes correspond to different individual print modes, respectively, which are image forming modes of different print speeds in the form of different image forming speeds. The rotational speeds of the developing roller 1 and the feed roller 2 in the plurality of print modes correspond to print speeds that are changed in accordance with the kind of the recording medium. Among these, a predetection rotational speed in a toner remaining amount detection mode, which is a developer remaining amount detection mode, is a rotational speed in one of the print modes. In this example, the predetection rotational speed is the fastest rotational speed (i.e., 1/1 speed) among speeds of the print modes.

In this embodiment, the 1/1 speed, which is the normal speed and the fastest speed among the above-mentioned print speeds, is set to the toner remaining amount detection mode in the form of the developer remaining amount detection mode, and an electrostatic capacitance detection operation is carried out for the other low speed print modes, but the result of such a detection operation is not updated and stored in the memory 23 that acts as a storage device.

Hereinafter, reference will be made to the results of verification of the rotational speed dependency of the feed roller 2 to the electrostatic capacitance between the developing roller 1 and the feed roller 2 in the developing unit 4 which is provided by the image forming apparatus of this embodiment, while referring to FIG. 10 and FIG. 11.

Figure 10:
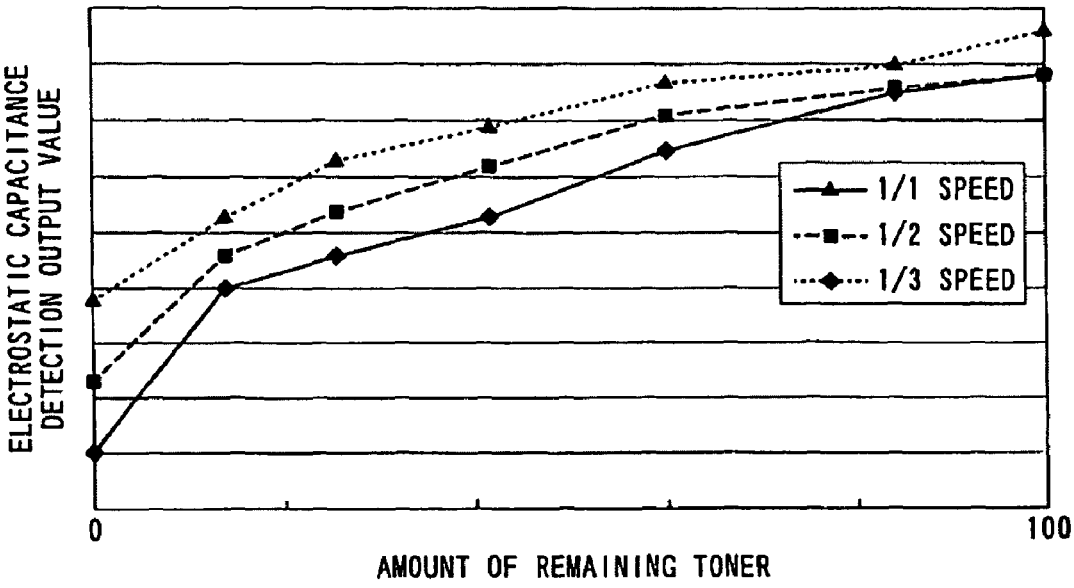
FIG. 10 is a graph showing the relationship between the amount of remaining developer % and the electrostatic capacitance detection output value in a developer remaining amount detection mode for each speed possessed by the image forming apparatus used for explanation in the first embodiment of the present invention.

FIG. 10 depicts an experimental result in this embodiment in which the change of the detection output value of the electrostatic capacitance between the feed roller 2 and the developing roller 1 was measured in a case where the rotational speed of the feed roller 2 was set to three reference levels and toner was consumed from a toner amount of 100% to 0% at the individual speeds, respectively. As is clear from FIG. 10, the electrostatic capacitance detection output value changed to shift to a larger side in accordance the decreasing rotational speed of the feed roller 2.

Figure 11:
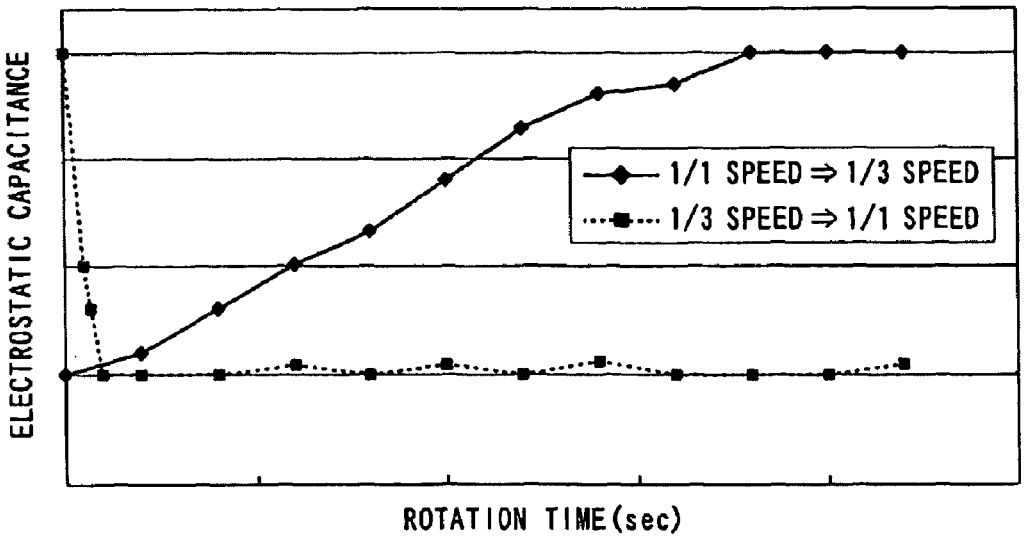
FIG. 11 is a graph showing the relationship between the rotation time and the electrostatic capacitance detection output value in case where the rotational speed of a developer feed member has been changed during its operation, in the image forming apparatus used for explanation in the first embodiment of the present invention.

FIG. 11 is an experimental result in which when the rotational speed of the feed roller 2 was changed in the image forming apparatus of this embodiment, the time required until the electrostatic capacitance detection output value was stabilized to the values inherent to the individual speeds. Dotted line plots in FIG. 11 denote the change of the capacitance value detecting output value with respect to the rotation time when rotation operation was performed in a non-printing state while the rotational speed of the feed roller 2 was changed from the ⅓ speed to the 1/1 speed at an amount of remaining toner tn of 40%. When changed from the ⅓ speed to the 1/1 speed, a tendency was exhibited that the electrostatic capacitance detection output value was quickly stabilized to a value inherent to the 1/1 speed. In this embodiment, the time required until the electrostatic capacitance detection output value was stabilized was less than 10 sec.

On the other hand, solid line plots in FIG. 11 denote the change of the capacitance value detecting output value with respect to the rotation time when rotation operation was performed in a non-printing state while the rotational speed of the feed roller 2 was changed from the 1/1 speed to the ⅓ speed at an amount of remaining toner tn of 40%. From the result of this experiment, it was found that when changed from the 1/1 speed to the ⅓ speed, it took a long period of time, i.e., more than 10 times longer than that taken in the above-mentioned experimental result when changed from the ⅓ speed to the 1/1 speed, until the electrostatic capacitance detection output value was stabilized to a value inherent to the ⅓ speed.

From the above verification experiments, it becomes clear that even if the amount of toner Tn in the developing container 3 is constant, as the rotational speed of the feed roller 2 becomes slower, the electrostatic capacitance detection output value changes greatly to a non-negligible extent and a longer time is required until the electrostatic capacitance detection output value is stabilized. If the conditions remain unchanged, it will be impossible to detect the change of the electrostatic capacitance according to the toner consumption, with the result that the accuracy of the toner remaining amount detection becomes remarkably low.

It is difficult to cope with this phenomenon by taking a measure to provide remaining amount detection tables for the individual rotational speeds of the feed roller 2, respectively, for example. Such a measure might still be effective if the electrostatic capacitance detection output value is quickly stabilized to an electrostatic capacitance inherent to the rotational speed of the feed roller 2 when the rotational speed becomes slow. However, as is evident from the above verification results, when the rotational speed of the feed roller 2 is changed to a low speed, toner is filled into the feed roller 2 little by little, as shown by the solid line plots in FIG. 11. Therefore, it will take a long time for the electrostatic capacitance detection output value to become a constant value, during which the electrostatic capacitance detection output value does not become stable. In a case where during that time, a lot of toner Tn has been consumed or speed changes between the ⅓ speed and the ½ speed have been frequently repeated, no stable electrostatic capacitance detection output value at each speed will not be obtained, and successive remaining amount detection will become difficult.

Here, the inventor has focused attention on the tendency that the electrostatic capacitance detection output value becomes stable quickly in a speed change from the ⅓ speed to the 1/1 speed, as shown by the dotted line plots in FIG. 11.

The inventor proposes the following method. That is, in this embodiment, each time the number of printed sheets accumulated in a low-speed print mode exceeds a set threshold, the rotation operation of the feed roller 2 is carried out at the 1/1 speed. Thereafter, a toner remaining amount detection operation is performed and the result thereof is updated and stored into the memory 23, thereby improving the accuracy of the toner remaining amount detection.

In this embodiment, the above-mentioned ½ speed and ⅓ speed are taken as low-speed print modes, and when the number of accumulated printed sheets T at both speeds (T=the number of printed sheets at the ½ speed plus the number of printed sheets at the ⅓ speed) becomes 50, a rotation operation is carried out. That is, the rotation operation of the feed roller 2 and the developing roller 1 is performed for 10 sec at the 1/1 speed, i.e., at the normal speed of this image forming apparatus. Thereafter, the driving stop of the feed roller 2 and the developing roller 1 as well as the separation operation of the developing roller 1 with respect to the photosensitive drum 11 (i.e., the above-mentioned toner remaining amount detection operation) are carried out, whereby an electrostatic capacitance detection output value is obtained. The result thus obtained is converted into numeric data, and the above-mentioned arithmetic calculation is carried out to provide an amount of remaining toner, which is then updated and stored in the memory 23 that acts as the storage device. Hereinafter, this operation is referred to as a 1/1 speed toner remaining amount detection sequence. That is, before the detection operation for detecting the amount of remaining toner, the developing roller 1 and the feed roller 2 are caused to rotate at the predetermined predetection rotational speed in the form of the 1/1 speed for a predetermined time, and thereafter, the toner remaining amount detection operation is carried out to detect the amount of remaining toner.

The above-mentioned number of accumulated printed sheets T is obtained by performing the image forming operation at the 1/1 speed for a period of 10 sec or more during the execution of the 1/1 speed developer remaining amount detection sequence. Then, after the developer remaining amount detection operation has been executed, the count is returned to zero (T=0) at a timing at which toner remaining amount information is updated and stored into the memory 23. In this embodiment, the memory 23 serves to store the number of accumulated printed sheets T=(the number of printed sheets at the ½ speed plus the number of printed sheets at the ⅓ speed).

Figure 12:
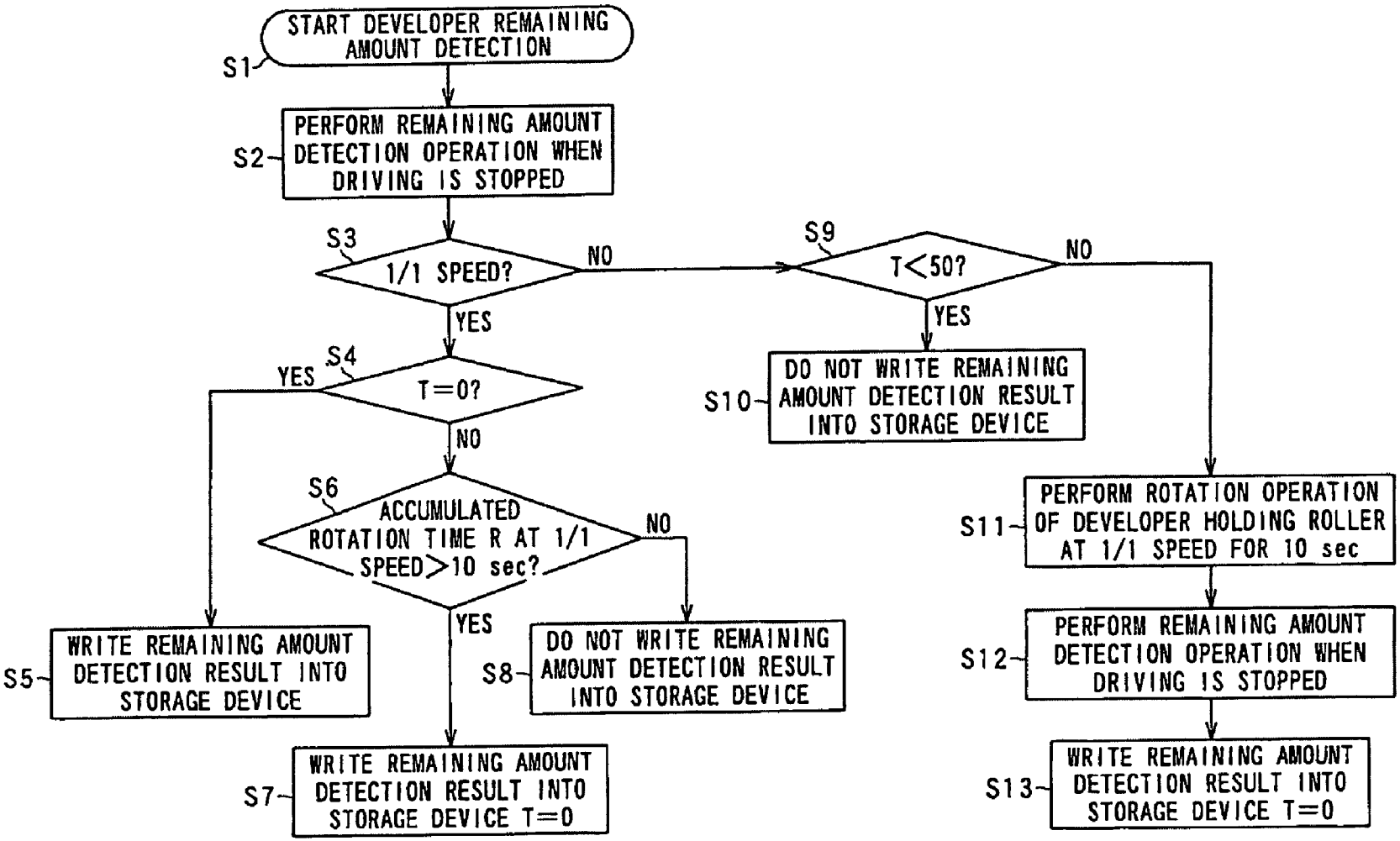
FIG. 12 is a flowchart for developer remaining amount detection of the image forming apparatus used for explanation in the first embodiment of the present invention.

Hereinafter, reference will be made to the 1/1 speed developer remaining amount detection sequence in this embodiment by using a flowchart in FIG. 12.

The sequence starts. In step S1, toner remaining amount detection is started. In step S2, a toner remaining amount detection operation is executed at the time when the driving of the feed roller 2 and the developing roller 1 is stopped. In step S3, it is determined whether the print mode before the driving is stopped is the 1/1 speed. If it is the 1/1 speed, the sequence shifts to step S4. If it is not the 1/1 speed, the sequence shifts to step S9. In step S4, it is determined whether T is equal to 0. If T is equal to 0, the sequence shifts to step S5. If T is not equal to 0, the sequence shifts to step S6. In step S5, the result of the toner remaining amount detection is written into the memory 23. In step S6, it is determined whether an accumulated rotation time R of the feed roller 2 from the time point at which the print mode became the 1/1 speed is larger than 10 sec. If R is larger than 10 sec, the sequence shifts to step S7. If R is not larger than 10 sec, the sequence shifts to step S8.

In step S7, the result of the toner remaining amount detection is written into the memory 23. Then, the count is reset to zero (T=0). In step S8, the toner remaining amount detection result is not written into the memory 23. In step S9, it is determined whether T (=the number of printed sheets at the ½ speed plus the number of printed sheets at the ⅓ speed) is less than 50. If T is less than 50, the sequence shifts to step S10. If T is not less than 50, the sequence shifts to step S11. In step S10, the toner remaining amount detection result is not written in the memory 23. In step S11, the rotation operation of the feed roller 2 and the developing roller 1 is executed at the 1/1 speed for 10 sec. In step S12, a toner remaining amount detection operation is executed at the time when the driving of the feed roller 2 and the developing roller 1 is stopped. In step S13, the result of the toner remaining amount detection is written into the memory 23. Then, the count is reset to zero (T=0). The sequence ends.

In the 1/1 speed toner remaining amount detection sequence as described above, the variation of the electrostatic capacitance detection output value according to the speed change to a low-speed print mode is switched over to the 1/1 speed at the predetermined timing, and a rotation operation is carried out for a short period of time. By this rotation operation, it is possible to obtain the result of the toner remaining amount detection with the output value variation being canceled. Therefore, by performing this 1/1 speed toner remaining amount detection sequence, the toner remaining amount detection can be performed in succession even if the toner is consumed while executing a low-speed print mode.

In addition, in this embodiment, the timing at which the CPU (controller) 22 acting as a control unit executes the above-mentioned 1/1 speed toner remaining amount detection sequence is decided by the use of an interval according to the number of printed sheets that is the number of sheets of image formation in the image forming mode. Further efficiency can be obtained by using, as image forming historical information, either one of the accumulated rotation time of the feed roller 2 and the number of accumulated counts of individual image signals that form the dots of images in the image formation, or a threshold formed by a combination of both of them, in addition to the number of printed sheets. It is effective to execute the 1/1 speed toner remaining amount detection sequence when any of these pieces of historical information satisfies a prescribed condition, or when a combination of either of these pieces of historical information satisfies a prescribed condition. In addition to the toner remaining amount information, at least one or more pieces of information among the number of printed sheets, the accumulated rotation time of the feed roller 2, and the number of accumulated counts of individual image signals that form the dots of images in the image formation is stored in the memory 23.

In addition, in the 1/1 speed remaining amount detection sequence of this embodiment, the 1/1 speed, which is the normal speed of this image forming apparatus, is used as the rotational speed in the predetection rotation. That is, in the toner remaining amount detection mode, the 1/1 speed, which is the fastest of the rotational speeds of the plurality of rotational speed modes, is used as the predetection rotation. However, the rotation speed is not limited to this but may be any rotational speed of the feed roller 2 and the developing roller 1 with which the electrostatic capacitance detection output value becomes stable in a quick manner, and a common electrostatic capacitance detection output value can be obtained throughout the consumption of the toner. That is, the ½ speed can be used if it is more effective than the ⅓ speed, and a rotational speed between the 1/1 speed and the ½ speed can also be used as the case may be. The predetection rotational speed need only be at least higher than the lowest rotational speed of the print mode. It is effective for print modes whose rotational speeds are lower than the predetection operational speed.

Moreover, in this embodiment, it is constructed such that a toner remaining amount detection operation is performed during post-rotation in a low-speed print mode. This is because the result of the electrostatic capacitance detection output value in a low-speed print mode is used as a means for detecting an anomalous failure, etc., of the developing unit 4. The effects of the present invention can of course be achieved even if in a low-speed print mode, the 1/1 speed toner remaining amount detection sequence is carried out without performing a toner remaining amount detection operation.

In this embodiment, reference has been made to the case where the present invention is applied to a process cartridge comprising a developing unit that is detachably attachable to an image forming apparatus main body, but the present invention can also be applied to an image forming apparatus which is not of the process cartridge type. In addition, the present invention can also be applied to a developing unit of such a construction that is fixedly arranged in an image forming apparatus main body with a toner alone being able to be replenished. Further, the present invention is also applicable to a construction in which a plurality of process cartridges receiving toners of mutually different colors, respectively, are arranged.

Embodiment 2

In a second embodiment of the present invention, it is featured that a toner remaining amount detection mode is provided separately from an image forming mode of an image forming apparatus. Here, note that the construction and operation of the image forming apparatus used in the second embodiment are the same as those of the above-mentioned first embodiment as long as there is no particular description, and hence an explanation thereof is omitted.

Hereinafter, this second embodiment will be described in detail. In this second embodiment, provision is made for a toner remaining amount detection mode in which the rotational speed of a feed roller is 300 rpm, which is two times faster than an image forming speed of 1/1 speed in the first embodiment. That is, one of rotational speed modes corresponds to the toner remaining amount detection mode, and the other rotational speed modes correspond to print modes which are image forming modes.

In this embodiment, a total sum of the numbers of accumulated counts of individual image signals (hereinafter pixel count) that form the dots of images in the image formation at image forming speeds including 1/1 speed, ½ speed, and ⅓ speed is denoted by Ptotal. When this Ptotal reaches a predetermined accumulated threshold A, the rotational speed of the feed roller is immediately changed to the rotational speed of the toner remaining amount detection mode of 300 rpm, and the rotation operation of the feed roller at this rotational speed is carried out for a period of 3 sec. Subsequently, when the driving of the feed roller and the developing roller is stopped, the above-mentioned toner remaining amount detection operation is carried out to obtain an electrostatic capacitance detection output value. The result thus obtained is converted into numeric data, and the above-mentioned arithmetic calculation is carried out to provide an amount of remaining toner, which is then updated and stored in the above-mentioned memory. Hereinafter, this operation is referred to as a toner remaining amount detection dedicated sequence.

In addition, the above-mentioned pixel count Ptotal, i.e., its accumulated count, is reset to 0 after the toner remaining amount detection dedicated sequence has been executed. Ptotal and the above-mentioned accumulated threshold A for the pixel count are stored in the memory 23 in this embodiment.

Figure 13:
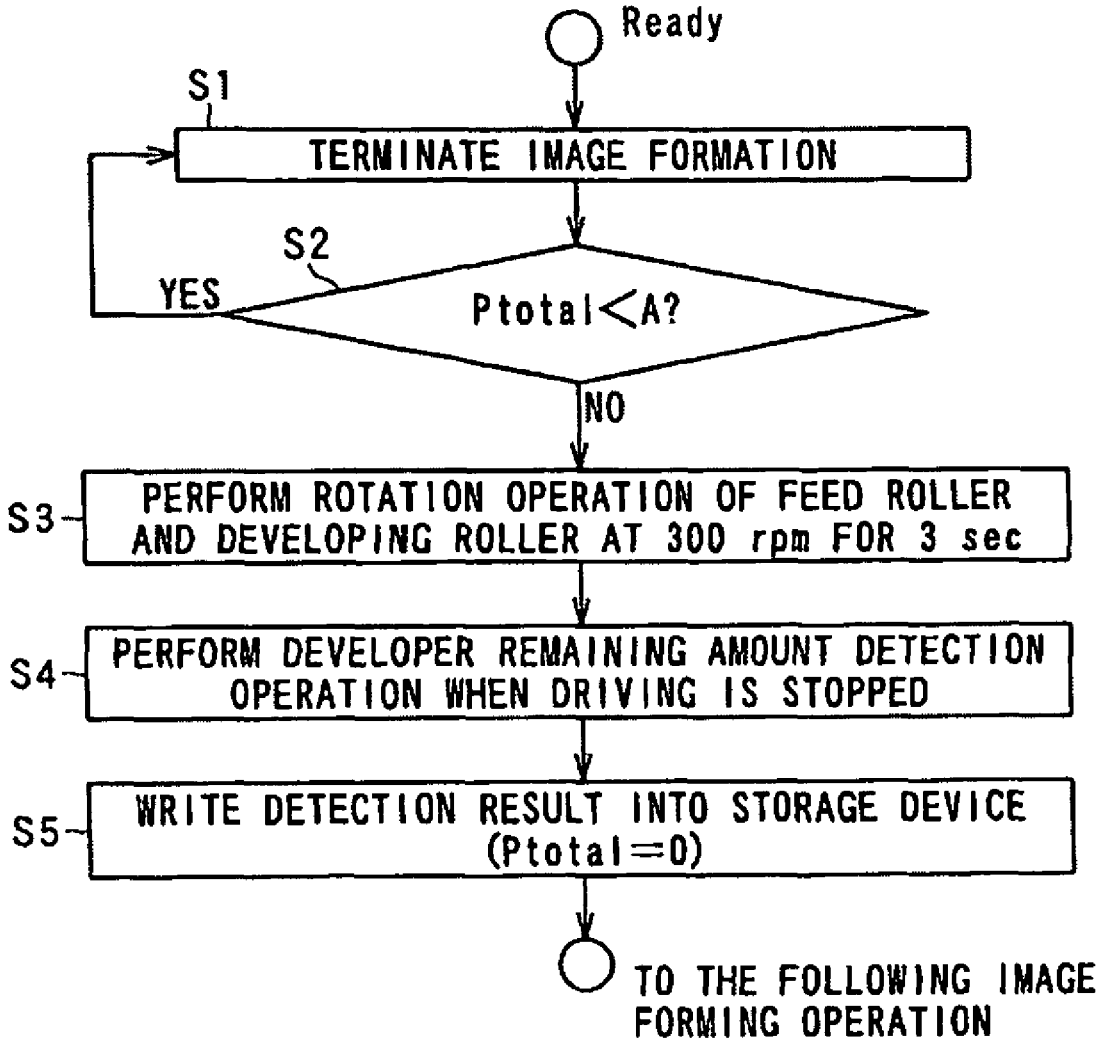
FIG. 13 is a flowchart for developer remaining amount detection of an image forming apparatus used for explanation in a second embodiment of the present invention.

Hereinafter, reference will be made to the toner remaining amount detection sequence in this embodiment by using a flowchart in FIG. 13.

The sequence starts. In step S1, the execution of an image forming operation is terminated. In step S2, Ptotal is checked. If Ptotal is less than A, the sequence shifts to a Ready state. If Ptotal is equal to or larger than A, the sequence shifts to step S3. In step S3, the rotation operation of the feed roller and the developing roller at a speed of 300 rpm is executed for 3 sec. In step S4, a toner remaining amount detection operation is executed at the time when the driving of the feed roller and the developing roller is stopped. In step S5, the result of the toner remaining amount detection is written into the memory. Then, Ptotal is reset to 0. The sequence ends.

In the toner remaining amount detection dedicated sequence as described above, the rotational speed of the feed roller and the developing roller is changed, at a predetermined timing, to the toner remaining amount detection mode in which the rotational speed is higher than those of the image forming modes. As a result, the variation of the electrostatic capacitance detection output value according to the change of the image forming speed can be canceled in an extremely short period of time, whereby an accurate toner remaining amount detection result can be obtained. Therefore, by performing the toner remaining amount detection dedicated sequence, the toner remaining amount detection can be performed in succession even if the toner is consumed while executing a low-speed print mode.

In this embodiment, the pixel count is used for the timing at which the toner remaining amount detection dedicated sequence is performed. However, the accumulated rotation time of the feed roller, or the number of sheets of image formation, or a threshold which is a combination of these time and number, can instead be used.

In addition, in the remaining amount detection dedicated sequence of this embodiment, a rotational speed is used which is two times faster than the 1/1 speed, which is the normal speed of this image forming apparatus. However, the rotational speed is not limited to this but may be any rotational speed of the feed roller and the developing roller with which the electrostatic capacitance detection output value becomes stable in a quick manner, and a common electrostatic capacitance detection output value can be obtained throughout the consumption of the toner.

Moreover, in this second embodiment, the feed roller and the developing roller are caused to rotate, but even with an operation in which only the feed roller is driven to rotate, the effects of the present invention can be achieved.

Further, in this second embodiment, a toner remaining amount detection operation is not carried out in the image forming mode, but the specification can be modified such that even in the image forming mode, a toner remaining amount detection operation is performed, and a detection result thereof is simply ignored.

In this second embodiment, reference has been made to the case where the present invention is applied to a process cartridge comprising a developing unit that is detachably attachable to an image forming apparatus main body, but the present invention can also be applied to an image forming apparatus which is not of the process cartridge type. In addition, the present invention can also be applied to a developing unit of such a construction that is fixedly arranged in an image forming apparatus main body with a toner alone being able to be replenished.

Embodiment 3

In a third embodiment of the present invention, it is featured that the successiveness (successive operation) of a toner remaining amount detection apparatus can be improved auxiliarily or additionally by performing correction control on the result of toner remaining amount detection in accordance with a prescribed condition in a case where the rotational speed is changed to a plurality of low-speed print modes in which the rotational speed is lower than the 1/1 speed. Here, note that the construction and operation of an image forming apparatus used in the third embodiment are the same as those of the above-mentioned first embodiment as long as there is no particular description, and hence an explanation thereof is omitted.

In the correction control in this third embodiment, it is featured that a comparison is made between an electrostatic capacitance detection output value in the case of the toner being not consumed, and an electrostatic capacitance detection output value in a state of the toner being consumed, among electrostatic capacitance detection output values after the image forming speed has been changed, and that a change in the electrostatic capacitance detection output values according to the toner consumption is captured. The successiveness of the toner remaining amount detection can be additionally improved by this correction control. This is achieved by making use of the fact that when the rotation operation of the feed roller is carried out in an unconsumed state of the toner after an operation has been changed to a low-speed print mode, the result of the electrostatic capacitance detection changes linearly with a fixed slope with respect to the rotation time of the feed roller, as shown in FIG. 11. The slope corresponds to a to be described later.

Next, reference will be made to the correction control in this third embodiment. Each time individual predetermined amounts of remaining toner were reached, the image forming speed was changed from the 1/1 speed to the 1/2 speed and the 1/3 speed, respectively, and thereafter an image forming operation was performed without consuming the toner until the electrostatic capacitance detection output value became stable. Table 1 shows different numeric data between electrostatic capacitance detection output values obtained at those times and the electrostatic capacitance detection output value of the 1/1 speed. In the image forming apparatus of this embodiment, the output voltage of the detector, which is replaced with numeric data of 8 bits, is used as an electrostatic capacitance detection output value. The change of the output value as shown in table 1 in this embodiment is set such that the output value at the time of the amount of toner being 100% is 100, and the output value changes by 10 per change of an electrostatic capacitance of 0.1 pF. Table 1 shows the change of the toner remaining amount detection output value at each image forming speed with respect to the amount of remaining toner, and the difference of the output value at each image forming speed from that at the 1/1 speed.

TABLE 1

| Amount of remaining developer % | Value of Δ with respect to 1/1 speed | |
|---|---|---|
| | 1/2 speed | 1/3 speed |
| 100-80% | 3 | 9 |
| 80-60% | 5 | 11 |
| 60-40% | 8 | 15 |
| 40-20% | 8 | 14 |
| 20-0% | 11 | 22 |

Table 2 shows the number of sheets of image formation in an unconsumed state of toner required until the electrostatic capacitance detection output value becomes stable after the image forming speed has been changed from the 1/1 speed to the 1/2 speed and the 1/3 speed. In addition, Table 2 also shows a decrease rate α of the electrostatic capacitance detection output value per sheet of an image forming operation in the unconsumed state of the toner, calculated from the difference numeric data between the above result and the electrostatic capacitance detection output value at the 1/1 speed in Table 1. Table 2 also shows the relation between the number of sheets (θ) until the electrostatic capacitance detection output value is stabilized to the output values at the individual speeds and the decrease rate α.

TABLE 2

| Amount of remaining developer % | β 1/2 speed | β 1/3 speed | α 1/2 speed | α 1/3 speed |
|---|---|---|---|---|
| 100-80% | 2 | 10 | 1.5 | 0.9 |
| 80-60% | 3 | 11 | 1.7 | 1.0 |
| 60-40% | 6 | 15 | 1.3 | 1.0 |
| 40-20% | 5 | 14 | 1.6 | 1.0 |
| 20-0% | 6 | 16 | 1.8 | 1.4 |

Based on the decrease rate α in Table 2 and the following relational expression, it is possible to estimate a difference β between the electrostatic capacitance detection output value when γ sheets of image forming operations are performed in the unconsumed state of toner after the image forming speed has been changed from the 1/1 speed to the ½ speed and the ⅓ speed, and the electrostatic capacitance detection output value at the 1/1 speed.

$$\beta=\alpha\times\gamma(0<\gamma\leqq\theta)$$

α: the decrease (increase) rate of the electrostatic capacitance detection output value per sheet of image formation in the unconsumed state of toner, β: the difference between the electrostatic capacitance detection output value in a low-speed print mode in the consumed state of toner and that at the 1/1 speed, γ: the number of accumulated printed sheets after the image forming speed has been changed to a low-speed print mode, and θ: the number of sheets of image formation until the electrostatic capacitance detection output value becomes stable after the image forming speed has been changed to a low-speed print mode.

In this correction control, the above-mentioned β is used. Assuming that the electrostatic capacitance detection output value detected in a low-speed print mode is X, a corrected electrostatic capacitance detection output value Y in a low-speed print mode is obtained from the following relational expression and the above-mentioned β.

$$Y=X+\beta$$

X: the electrostatic capacitance detection output value detected in a low-speed print mode, and Y: the corrected electrostatic capacitance detection output value in the low-speed print mode.

The electrostatic capacitance detection output value X detected in the low-speed print mode includes both of an electrostatic capacitance change due to the consumption of toner and an electrostatic capacitance change due to the change of the image forming speed. By adding the above-mentioned β, which is the capacitance change amount due to the change of the image forming speed, to X, the change of the electrostatic capacitance due to the image forming speed change is canceled, whereby the current or corrected electrostatic capacitance detection output value Y can be obtained in a quick manner.

That is, when the image forming speed has been changed from one in the toner remaining amount detection mode to another in another print mode, the change (β=(α×γ)) in the electrostatic capacitance due to the image forming speed change is counterbalanced from the electrostatic capacitance detection output value (X) after the image forming speed has been changed. Then, the electrostatic capacitance detection output value (X) is corrected to an electrostatic capacitance in the toner remaining amount detection mode (the 1/1 speed) that is a basic or reference developer remaining amount detection mode. Accordingly, the electrostatic capacitance thus obtained provides a toner remaining amount detection result which serves as a developer remaining amount detection result. In addition, in this correction control, when y exceeds θ, it is fixed to θ (γ=θ), whereby the current amount of remaining toner is estimated. In addition, the above-mentioned a is decided from the result of table 2 by referring to the table for each toner remaining amount %. In this manner, the correction condition for the electrostatic capacitance detection result in a print mode that is the image forming mode is changed in accordance with the amount of remaining toner in the form of the amount of remaining developer.

Figure 14:
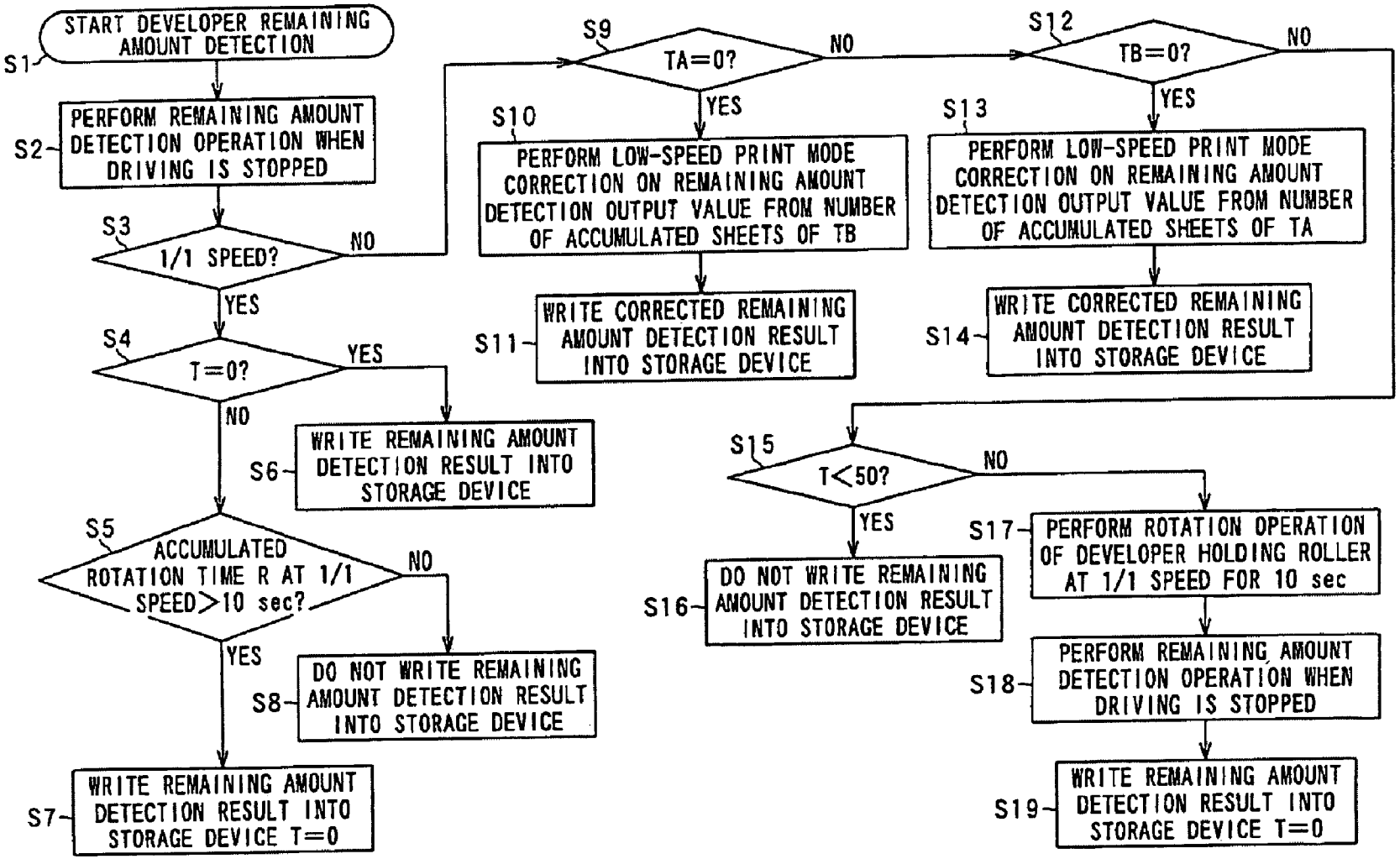
FIG. 14 is a flowchart for developer remaining amount detection of an image forming apparatus used for explanation in a third embodiment of the present invention.
Figure 15:
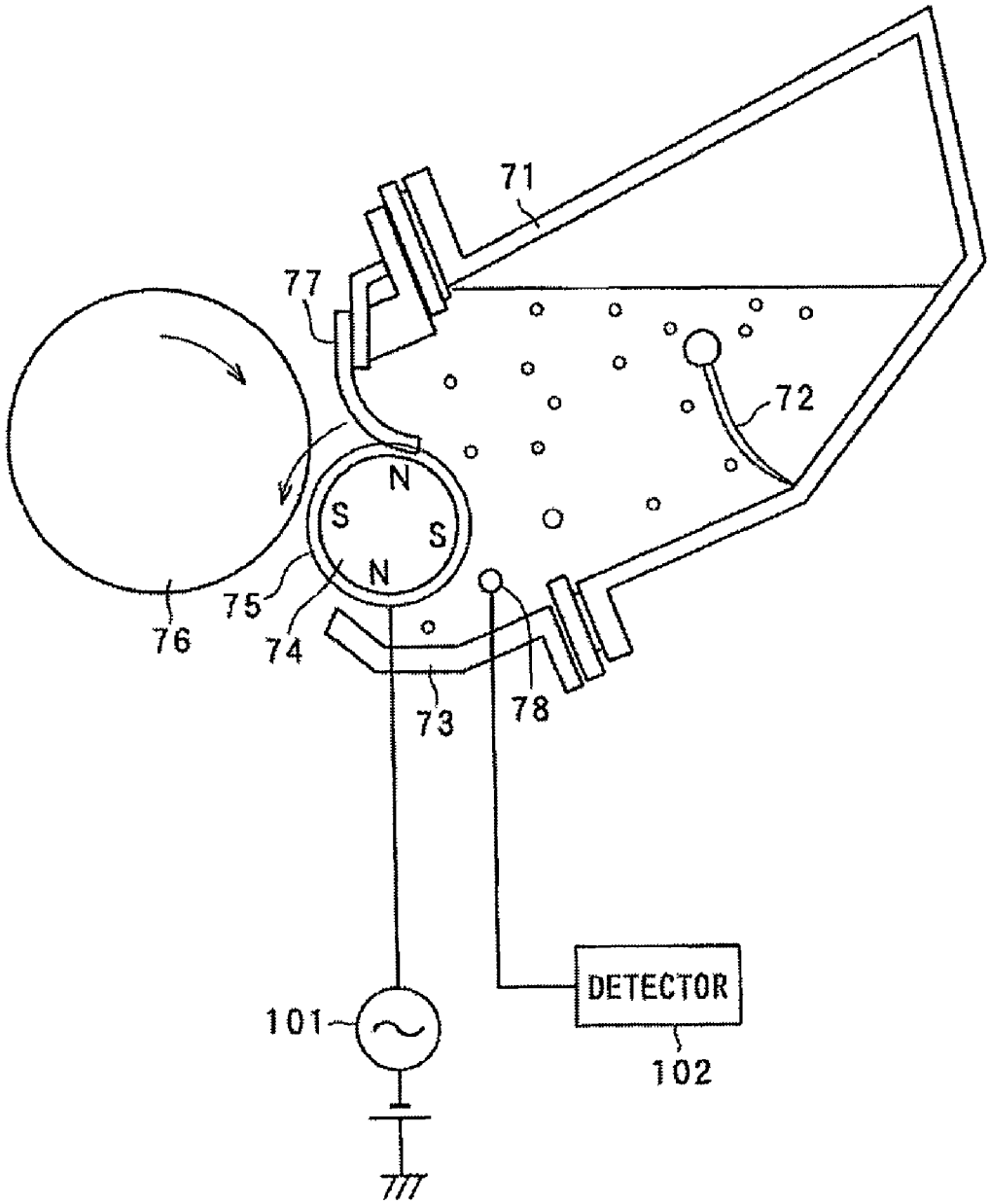
FIG. 15 depicts an image forming apparatus used for explanation in the related background art section.
Figure 16:
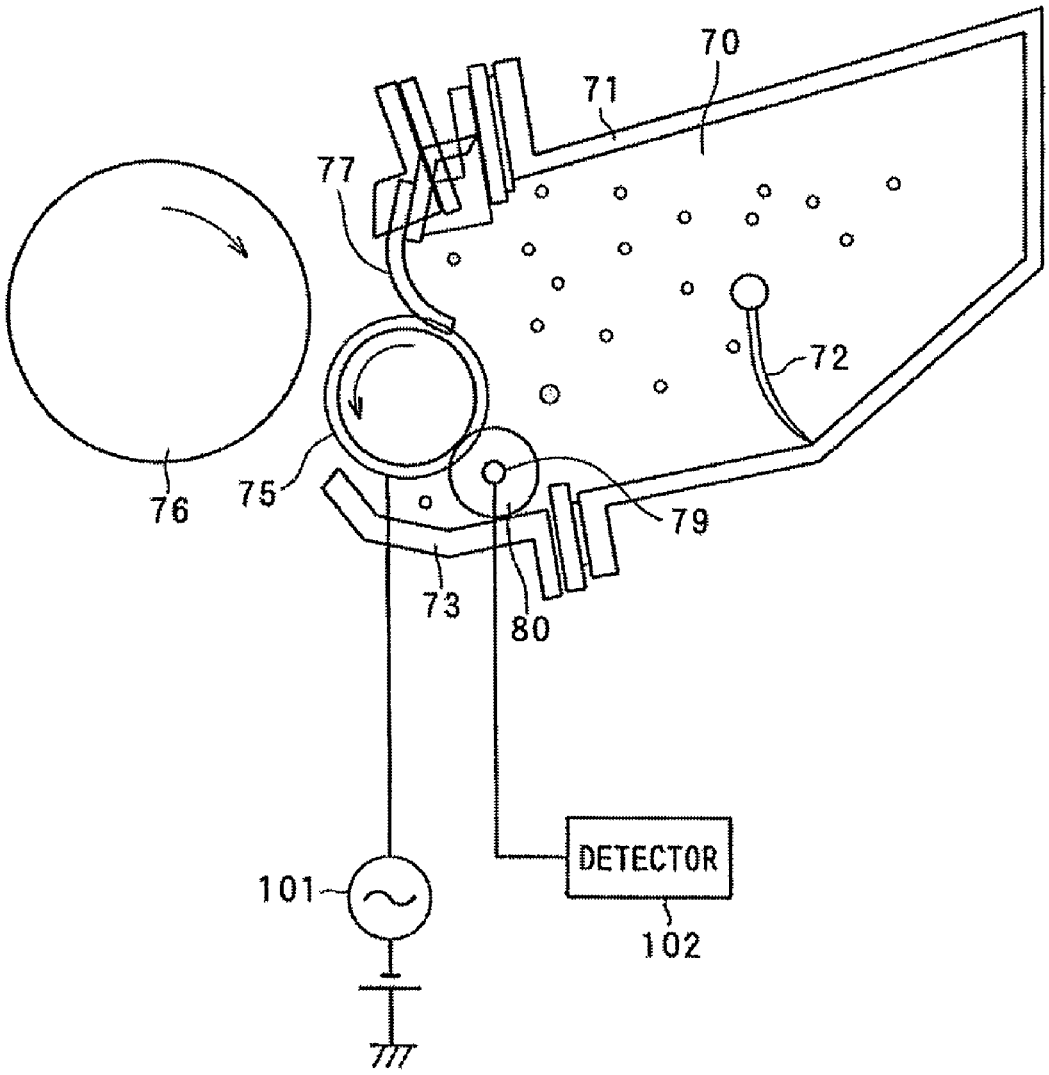
FIG. 16 depicts another image forming apparatus used for explanation in the related background art section.

Hereinafter, reference will be made to the toner remaining amount correction control in this third embodiment by using a flowchart in FIG. 14. In this embodiment, the memory 23 serves to store the number of accumulated printed sheets T=((the number of printed sheets at the ½ speed: TA) plus (the number of printed sheets at the ⅓ speed: TB))

The sequence starts. In step S1, toner remaining amount detection is started. In step S2, a toner remaining amount detection operation is executed at the time when the driving of the feed roller and the developing roller is stopped. In step S3, it is determined whether the print mode before the driving is stopped is the 1/1 speed. If it is the 1/1 speed, the sequence shifts to step S4. If it is not the 1/1 speed, the sequence shifts to step S9. In step S4, it is determined whether T is equal to 0. If T is equal to 0, the sequence shifts to step S5. If T is not equal to 0, the sequence shifts to step S6. In step S5, the result of the toner remaining amount detection is written into the memory. In step S6, it is determined whether an accumulated rotation time R of the feed roller from the time point at which the print mode became the 1/1 speed is larger than 10 sec. If R is larger than 10 sec. the sequence shifts to step S7. If R is not larger than 10 sec, the sequence shifts to step S8.

In step S7, the result of the toner remaining amount detection is written into the memory. Then, the count is reset to zero (T=0). In step S8, the toner remaining amount detection result is not written into the memory. In step S9, it is determined whether the number of printed sheets TA at the ½ speed is equal to 0. If TA is equal to 0, the sequence shifts to step S10. If TA is not equal to 0, the sequence shifts to step S12. In step S10, the toner remaining amount detection output value at the ⅓ speed is subjected to a low-speed print mode correction from the number of accumulated printed sheets TB at the ⅓ speed.

In step S11, the corrected value of the toner remaining amount detection is written into the memory. In step S12, it is determined whether the number of printed sheets TB at the ⅓ speed is equal to 0. If TB is equal to 0, the sequence shifts to step S13. If TB is not equal to 0, the sequence shifts to step S15. In step S13, the toner remaining amount detection output value at the ½ speed is subjected to the low-speed print mode correction from the number of accumulated printed sheets TA at the ½ speed. In step S14, the result of the toner remaining amount detection correction is written into the memory. In step S15, it is determined whether T is less than 50. If T is less than 50, the sequence shifts to step S16. If T is not less than 50, the sequence shifts to step S17. In step S16, the result of the toner remaining amount detection correction is not written into the memory. In step S17, the rotation operation of the feed roller is performed at the 1/1 speed for 10 sec. In step S18, a toner remaining amount detection operation is executed at the time when the driving of the feed roller and the developing roller is stopped. In step S19, the result of the toner remaining amount detection is written into the memory. Then, the count is reset to zero (T=0). The sequence ends.

Even during the time when the electrostatic capacitance detection output value becomes unstable immediately after the image forming speed has been changed to a low-speed print mode, the change in the toner remaining amount detection output value according to the toner consumption can be caught by means of the correction control of the above-mentioned sequence, thus making it possible to perform the toner remaining amount detection. In addition, when the image forming speed has been changed from the 1/2 speed to the 1/3 speed, or from the 1/3 speed to the 1/2 speed, as shown in the sequence chart in FIG. 14, a deviation of the correction result becomes large. Therefore, in this third embodiment, the specification is modified such that in a case where such a situation has occurred, accurate toner remaining amount detection can be made at a predetermined timing according to the 1/1 speed remaining amount detection sequence. In this manner, the correction condition for the electrostatic capacitance detection results in the print modes at the 1/2 speed and the 1/3 speed, which are image forming modes, is changed in accordance with the image forming speeds in the print modes which are the image forming modes.

In the correction control in this third embodiment, the number of accumulated printed sheets $\gamma$ in a low-speed print mode after the image forming speed has been changed from the 1/1 speed is used, but the number of accumulated revolutions of the toner feed member can instead be used. The correction condition is changed in accordance with the number of accumulated sheets in the image forming mode and the accumulated time of image formation. In addition to the toner remaining amount information, either or both of the number of sheets of image formation and the accumulated rotation time of the feed roller are stored in the memory 23.

As shown in the first embodiment, in the 1/1 speed remaining amount detection sequence, the 1/1 speed, which is the normal speed of the image forming apparatus, is used. However, the rotational speed is not limited to this but may be any rotational speed of a toner holding roller with which the rotational speed of the toner holding roller becomes stable in a quick manner, and a common electrostatic capacitance detection output value can be obtained throughout the consumption of the toner.

In this embodiment, reference has been made to the case where the present invention is applied to a process cartridge comprising a developing unit that is detachably attachable to an image forming apparatus main body, but the present invention can also be applied to an image forming apparatus which is not of the process cartridge type. In addition, the present invention can also be applied to a developing unit of such a construction that is fixedly arranged in an image forming apparatus main body with a toner alone being able to be replenished. Further, the present invention can also be applied to a process cartridge which has the above-mentioned developing unit, the photosensitive drum, the cleaning blade, the waste toner container, and the charging device integrally formed with one another, and which is detachably attachable to the image forming apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-113252, filed on Apr. 23, 2008, which is hereby incorporated by reference herein in its entirety.

What is claimed is:

1. An image forming apparatus having a plurality of image forming speeds, the image forming apparatus comprising:

an image bearing member on which an electrostatic image is formed:

a developing container that receives a developer;

a developer carrying member that is arranged to be rotatable and conveys the developer so as to develop said electrostatic image;

a developer feed member that is arranged in contact with said developer carrying member and to be rotatable, wherein said developer feed member feeds the developer to said developer carrying member;

a detection device that detects an amount of developer in said developing container by detecting an electrostatic capacitance between said developer carrying member and said developer feed member; and a control unit that changes a rotational speed of said developer feed member into a plurality of developer feed member rotational speeds corresponding to the plurality of image forming speeds, wherein said control unit controls the rotational speed of said developer feed member prior to an execution of a detection operation of said detection device so as to be faster than the slowest speed of the plurality of developer feed member rotational speeds, and wherein said control unit decides a timing at which said detection operation is carried out, based on historical information of image formation.

2. The image forming apparatus as set forth in claim 1, wherein the historical information of image formation is at least one of: (i) a number of sheets of image formation, (ii) a rotation time of said developer feed member, and (iii) a number of accumulated counts of individual image signals that form the dots of images in the image formation.

3. The image forming apparatus as set forth in claim 1, further comprising:

a memory that stores information on the amount of developer in said developing container and the historical information of image formation.

4. An image forming apparatus having a plurality of image forming speeds, the image forming apparatus comprising:

an image bearing member on which an electrostatic image is formed;

a developing container that receives a developer;

a developer carrying member that is arranged to be rotatable and conveys the developer so as to develop said electrostatic image;

a developer feed member that is arranged in contact with said developer carrying member and to be rotatable, wherein said developer feed member feeds the developer to said developer carrying member;

a detection device that detects an amount of developer in said developing container by detecting an electrostatic capacitance between said developer carrying member and said developer feed member; and a control unit that changes a rotational speed of said developer feed member into a plurality of developer feed member rotational speeds corresponding to the plurality of image forming speeds, wherein said control unit can control the rotational speed of said developer feed member prior to an execution of a detection operation of said detection device so as to be the fastest speed of the plurality of developer feed member rotational speeds, and wherein said control unit can perform the detection operation at a state in which the rotational speed of said developer feed member prior to the execution of the detection operation is slower than the fastest speed thereof, and said detection device detects the amount of developer in said developing container by correcting a detection result of the electrostatic capacitance when performing the detection operation at a developer feed member rotational speed that is slower than the fastest speed.

5. The image forming apparatus as set forth in claim 4, wherein said detection device changes a correction condition upon execution of the correction in accordance with a number of sheets of image formation after an image forming speed is changed.

* * * * *